US005541626A

United States Patent [19]

Hiramatsu et al.

[11] Patent Number: 5,541,626

[45] Date of Patent: Jul. 30, 1996

[54] RECORDING APPARATUS AND METHOD FOR MANUFACTURING RECORDED PRODUCT THEREBY

[75] Inventors: Akira Hiramatsu; Akio Suzuki, both of Yokohama; Yoshihiro Takada; Yasushi Miura, both of Kawasaki; Nobuhiko Ogata, Tokyo, all of Japan

[73] Assignee: Canon Kabushiki Kaisha, Tokyo, Japan

[21] Appl. No.: 20,973

[22] Filed: Feb. 22, 1993

[30] Foreign Application Priority Data

Feb. 26, 1992 [JP] Japan ..... 4-039486
Feb. 9, 1993 [JP] Japan ..... 5-021452

[51] Int. Cl.[6] ..... B41J 2/01; B41J 11/42; B41J 29/48

[52] U.S. Cl. ..... 347/8; 400/55; 400/708

[58] Field of Search ..... 346/1.1, 139 R, 346/140 R; 347/8, 101, 104; 400/55, 708

[56] References Cited

U.S. PATENT DOCUMENTS

| | | | |
|---|---|---|---|
| 4,313,124 | 1/1982 | Hara | 346/140 R |
| 4,345,262 | 8/1982 | Shirato et al. | 346/140 R |
| 4,459,600 | 7/1984 | Sato et al. | 346/140 R |
| 4,463,359 | 7/1984 | Ayata et al. | 346/1.1 |
| 4,558,333 | 12/1985 | Sugitani et al. | 346/140 R |
| 4,723,129 | 2/1988 | Endo et al. | 346/1.1 |
| 4,725,849 | 2/1988 | Koike et al. | 346/1.1 |
| 4,740,796 | 4/1988 | Endo et al. | 346/1.1 |

FOREIGN PATENT DOCUMENTS

| | | |
|---|---|---|
| 0170137 | 2/1986 | European Pat. Off. . |
| 0387641 | 9/1990 | European Pat. Off. . |
| 2342163 | 9/1977 | France . |
| 54-056847 | 5/1979 | Japan . |
| 58-194589 | 11/1983 | Japan . |
| 59-123670 | 7/1984 | Japan . |
| 59-138461 | 8/1984 | Japan . |
| 60-071260 | 4/1985 | Japan . |
| 61-274973 | 12/1986 | Japan . |
| 62-053492 | 3/1987 | Japan . |
| 1-38247 | 2/1989 | Japan . |
| 1122474 | 5/1989 | Japan . |
| 2086457 | 3/1990 | Japan . |
| 2217278 | 8/1990 | Japan . |
| 3046589 | 7/1991 | Japan . |

*Primary Examiner*—Benjamin R. Fuller
*Assistant Examiner*—Alrick Bobb
*Attorney, Agent, or Firm*—Fitzpatrick, Cella, Harper & Scinto

[57] ABSTRACT

A recording apparatus for recording an image, by a recording device, on a recording medium having been conveyed to a position opposite to the recording device. The apparatus comprises a conveyor for conveying the recording medium to a recording region where a platen is disposed, a detector for detecting a floating amount and/or a floating angle of the recording medium with respect to the platen, and a selector for selecting either a first mode to continue the recording operation by varying the distance between the recording device and the recording medium in accordance with the detected result of the detector or a second mode to stop the recording operation. According to such a recording apparatus, it is possible to perform a high-quality recording operation since the distance between the recording head and the recording medium can be kept optimum.

40 Claims, 16 Drawing Sheets

RECORDING APPARATUS AND METHOD FOR MANUFACTURING RECORDED PRODUCT THEREBY

BACKGROUND OF THE INVENTION

1. Field of the Invention

The present invention relates to a recording apparatus for recording on a recording medium using a recording means, and a method for manufacturing a recorded product by the recording apparatus.

2. Related Background Art

Heretofore, recording apparatuses using a variety of image forming means have been put to practical use. Particularly regarding full-colored image forming means, an ink jet recording apparatus is attracting public attention. This is because the ink jet recording apparatus discharges ink as liquid drops through a discharge port of a recording head for performing dot recording and has advantages in composition and running cost, etc. Typically, in this recording method, a recording head having a row of discharge port(s) with a predetermined width (approximately 16 mm) is applied to scan a recording medium relatively and sequentially in the longitudinal and lateral directions for recording and printing.

In such a type of recording apparatus, the gap between the recording head and the recording material, i.e. recording medium, is set to an optimum value, which is kept unchanged during the recording operation.

As a typical example of a dyeing recording apparatus which is further an example of the above-mentioned recording apparatus, a textile printing apparatus will now be described.

As a conventionally representative textile printing apparatus, there has been known a type using a silk-screen textile printing method in which the printing operation is directly applied on cloths using silk-screen printing. In a screen textile printing method, a screen form is made for each color of an original image to be printed and the ink is directly transferred through the texture of silk to cloths made of cotton, silk and others.

However, such a screen textile printing method has such disadvantages as requiring a significant number of processes and time for making screen forms, and complicated labor for blending inks of various colors needed for printing and for alignment of the screen forms. In addition, the apparatus is basically large-sized, so the more the number of colors to be used, the larger the space needed for installation of the apparatus. Moreover, a storage space for the screen forms must be kept separately.

To overcome such disadvantages, there has been known a technique to print directly on the cloths, i.e. a printing member by the ink jet recording method in which particulates of inks are blown out for forming an image. Further, as a systematized version of this technique, it is possible to read the original image by a reader into a computer for processing the image in a variety of ways, so as to subsequently supply the recording signals to the recording section of the ink jet for the printing process.

According to such a technique, since no screen form is necessary to perform screen textile printing, the processes and time until the printing process can be significantly reduced, enabling small-packaging of the apparatus. Further, the image data for the printing can be stored in a tape, a floppy disk or an optical disc medium, with an excellent keeping and storing property. In addition, processes such as color change, layout change, scale-up/down can be easily applied on the original image.

There are a variety of requirements for the recording medium. In addition to a paper being a typical recording medium and a transparent film used for OHP (Over Head Projector) (e.g. OHP sheet), in recent years a long staple processed paper and a fabric have been required to be used. Then, when recording operation is applied to such a recording material comprising long staple by an ink jet recording apparatus, since the set value of a gap between the recording head and the recording medium is typically so small as 0.5–1 mm, there has been a disadvantage that the recording head absorbs the ink just after it is recorded and the extended recording medium and the recording head are rubbed against each other, thereby blurring the recorded image so as to degrade the image quality.

Further, the similar blurring would also occur when the recording medium is crumpled and floated, and in the worst case an end of the recording medium and the recording head would collide to break or damage the recording material. Particularly when a film or a fabric is used as the recording medium, the intensity of the recording medium is significantly high. Therefore, any collision of the recording medium end and the recording head would seriously and undesirably affect the recording head carrying mechanism so as to lower the positional accuracy between the recording head and the recording medium.

It is therefore an object of this invention to provide a recording apparatus which is capable of preventing any rubbing of a recording medium and a recording head by a simple structure and preventing the lowering of the recorded image quality and an undesirable effect to the apparatus.

Further, the technique of the present invention would contribute to overcome a problem due to the difference of the thickness of the recording medium. Such a problem occurring when image data is recorded onto cloths as a recording medium by the above-mentioned dyeing apparatus, as an example, will be now described.

As shown in FIGS. 7A, 7B and 7C, when the thickness of cloths are different as $\mathbf{1}_0$, $\mathbf{1}_1$, $\mathbf{1}_2$ ($\mathbf{1}_0<\mathbf{1}_1<\mathbf{1}_2$), the distance between the surface of the cloths 60 and a discharging aperture 29 of the recording head 10 when the cloths 60 are attached to the conveying belt 37 and ink drops are ejected onto the cloths 60 by the recording head 10 would be varied as $d_0$, $d_1$, $d_2$ ($d_0>d_1>d_2$), respectively. As a result, the deviate amount t, shown in FIG. 9, of the ink drops discharged from the recording head 10 to the recording dot-reaching position from an ideal dot-reaching position on the cloths 60 would be proportional to the distance d between the surface of the cloths 60 and the discharge port 29 of the recording head 10. When the distance between the cloths and the recording head exceeds a distance $d_0$ such that the recorded dot reaching deviated amount becomes greater than the critical recording dot reaching deviated amount $t_0$ (μm), undesirable white streaks out of the tolerance due to the recorded dot reaching deviation would appear, seriously degrading the recording image quality.

On the contrary, when the distance between the surface of the cloths 60 and the discharge port 29 of the recording head 10 becomes too small, although the deviated amount t (μm) of the reached dot becomes small, the fabric system projecting to the surface of the cloths would contact the discharge port 29 of the recording head 10, so as to disturb ejection of the ink drops correctly from the nozzle of the recording head 10.

SUMMARY OF THE INVENTION

It is therefore an object of the present invention to provide a recording apparatus capable of performing a high-quality recording operation keeping the distance between the recording head and the recording medium to be optimum.

It is another object of the present invention to provide a recording apparatus capable of securely preventing any damage to the recording means due to its contact with the recording medium by detecting a conveying abnormality (e.g. floating amount and/or angle of the recording medium from the platen).

It is another object of the present invention to provide a recording apparatus for recording an image, by a recording means, on a recording medium having been conveyed to a position opposite to the recording means, said apparatus comprising: conveying means for conveying the recording medium to a recording region where a platen is disposed; a detecting means for detecting a floating amount and/or floating angle of the recording medium from the platen; and a means for selecting either a first mode to continue the recording operation by varying the distance between the recording means and the recording medium in accordance with the detected result of said detecting means or a second mode to stop the recording operation.

It is further another object of the present invention to provide a method for producing an ink jet recorded object by recording an image, by an ink jet recording means, on a recording medium having been conveyed to a position opposite to the recording means, said method comprising the steps of: conveying the recording medium to a recording region where a platen is disposed; detecting a floating amount and/or angle of the recording medium from the platen; and selecting either a first mode to continue the recording operation by varying a distance between the recording means and the recording medium in accordance with the detected result of said detecting step or a second mode to stop the recording operation.

It is furthermore another object of the present invention to provide a means capable of variably setting the distance between the surface of the cloths and the recording head automatically or manually in accordance with the difference in the thickness of the cloths such that the images can be recorded on more kinds of cloths uniformly in high-quality, so as to perform the image recording by the ink jet recording means with the most suitable distance with respect to the thickness of the cloths to be recorded.

The above and other advantages, features and additional objects of this invention will be manifest to those versed in the art upon making reference to the following detailed description and the accompanying drawings in which a structural embodiment incorporating the principles of this invention is shown by way of illustrative example.

DETAILED DESCRIPTION OF THE PREFERRED EMBODIMENTS

Embodiments of the present invention will now be described with reference to the accompanying drawings.

Figure 1:
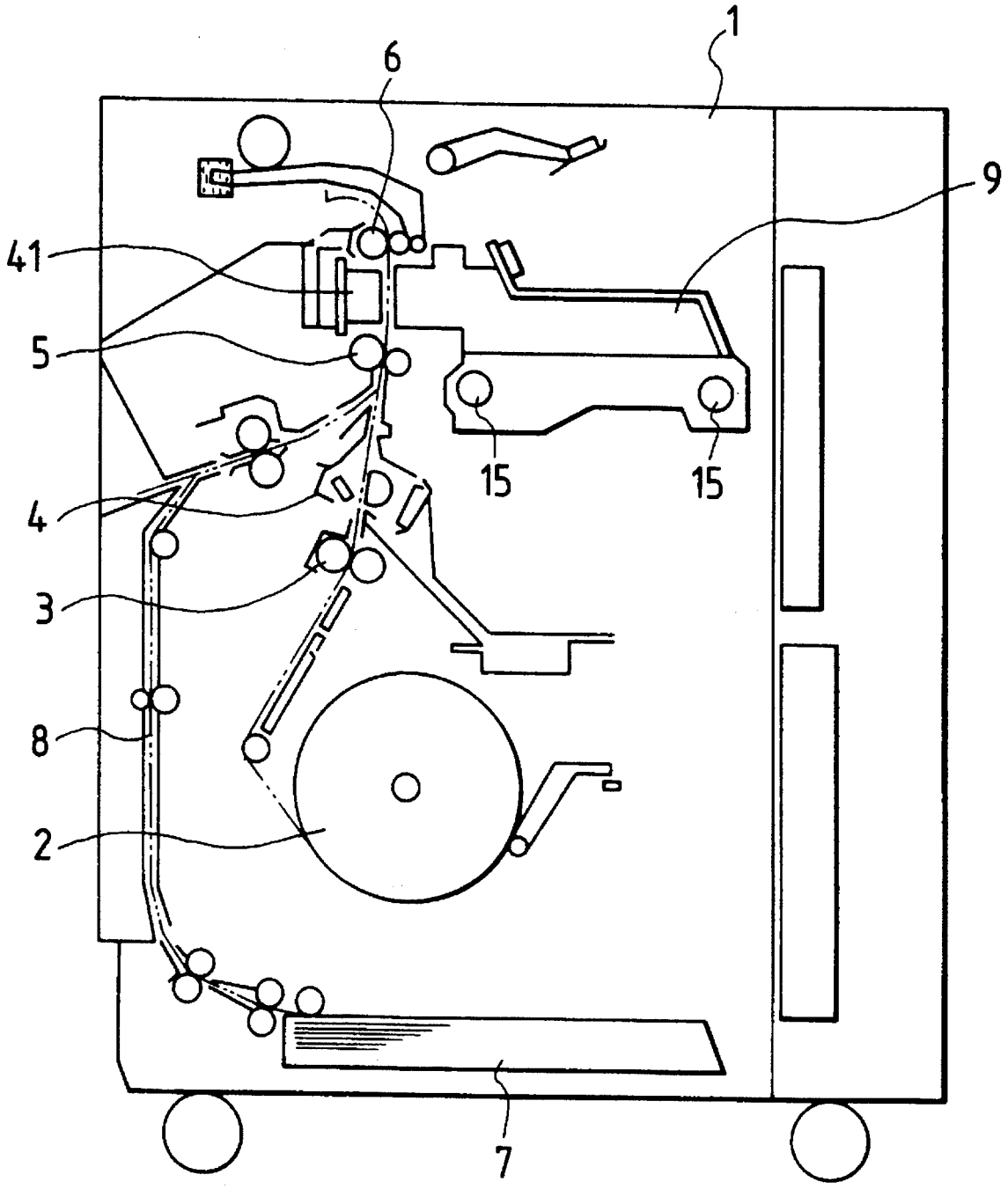
FIG. 1 is a cross-sectional view showing a composition of a recording apparatus according to an embodiment of the present invention.

FIG. 1 is a cross-sectional view of an embodiment of a recording apparatus according to the present invention. In FIG. 1, the numerals designate respectively: 1, a recording apparatus body; 2, a roll for holding a long film-like recording medium by winding therearound; 4, a cutter for cutting in a predetermined length the recording medium of the roll 2; 5, a pair of conveying rollers for conveying the recording medium in the conveying direction respectively; 6, a sub-scanning roller for positioning the recording medium by conveying by a predetermined amount corresponding to a recording width of a recording head later mentioned. With these components, a conveying path for the recording medium supplied from the roll 2 is constituted.

Likewise, reference numeral 7 is a cassette for storing cut recording medium; 8, a guide portion for guiding and conveying the recording medium supplied from the cassette 7. The recording medium having been conveyed from the cassette 7 will meet the conveying path for the recording medium supplied from the roll 2 just before the conveying roller 5. The numeral 9 designates a carriage including the recording head described later which is supplied to be movable in the vertical direction of the drawing by a pair of main-scanning rails 15. A platen 41 is disposed at a position opposed to the carriage 9 with the recording medium therebetween, and is provided with an absorbing means (not shown) such as an air-absorbing or electrostatic absorbing plate for keeping the recording medium flat by preventing the recording medium from floating during the recording operation and from contacting with the recording head.

The peripheral composition of the recording head will now be described with reference to FIG. 2.

The carriage 9 includes four recording heads 10C, 10M, 10Y and 10BK corresponding to the colors cyan, magenta, yellow and black respectively. An ink supplying system 11 for supplying ink to the recording heads 9C, 9M, 9Y and 9BK comprises ink cartridges 11C, 11M, 11Y and 11BK corresponding respectively to the colors cyan, magenta, yellow and black. The ink is supplied from the ink cartridges 11C, 11M, 11Y and 11BK through tubes 12C, 12M, 12Y and 12BK coupled thereto respectively, by a not shown pump. A motor 69 for scanning and driving the carriage 9 in the main-scanning direction (left-right direction) drives the carriage 9 through a driving pulley 80, and pulley 82 and a belt 84 fixed thereto. A motor 70 for scanning and driving the ink supplying system 11 synchronously with the carriage 9 in the main-scanning direction (left-right direction) drives the ink supplying system 11 through a driving pulley 81, a pulley 83 and a belt 85 coupled thereto.

The numeral 94 designates a recording medium in rolled or cut form as aforementioned, and conveyed in the upward direction of the drawing by the conveying roller 5 and the sub-scanning roller 6. A recovery device 20, for performing a process (hereinafter referred to as discharging recovery process) of stabilizing the discharging property by eliminating factors of lowering the image quality, is disposed outside of the scanning range of the carriage 9. The recovery device 20 eliminates the plugging of the discharge port of the recording heads 10C, 10M, 10Y and 10BK by covering the discharge port surfaces (surfaces opposed to the recording medium 94) of the recording heads 10C, 10M, 10Y and 10BK, and subsequently with such a state performing the ink discharge by driving the recording heads 10C, 10M, 10Y and 10BK or by applying pressure. Further, the discharge port is cleaned by introducing a high-speed air flow into the discharge port of the recording head and blowing out the residual ink, dusts and fuzz and the like which remained after the ink discharge by the air flow, in the cap member of the recovery device 20.

The numerals 92 and 93 designates a light emitting unit and a light receiving unit for detecting the floating of the recording medium 94 in vicinity of the recording region.

Next, the carriage 9 will be described with reference to FIGS. 3A and 3B.

Figure 2:
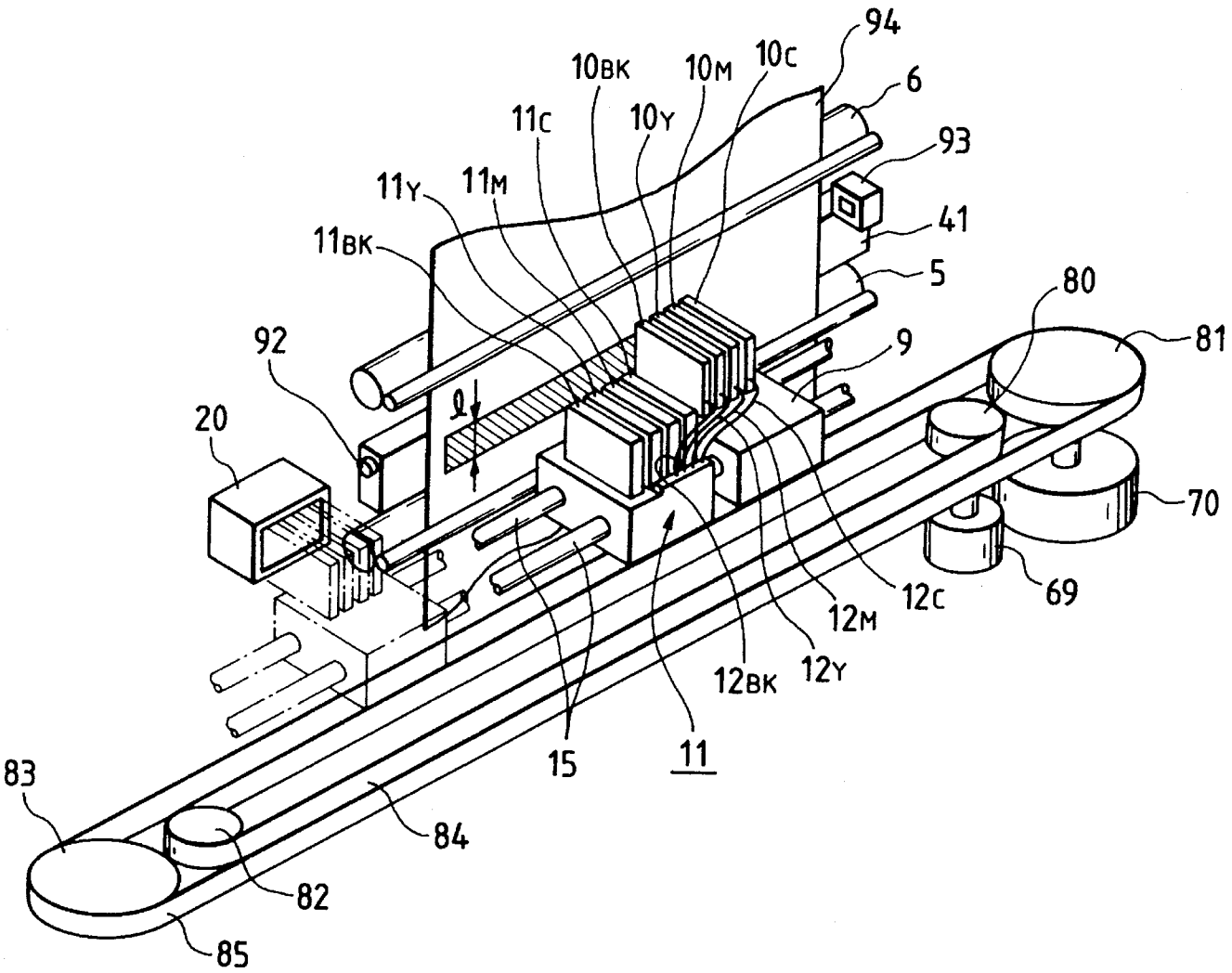
FIG. 2 is a perspective view showing a periphery of the recording head in FIG. 1.
Figure 3A:
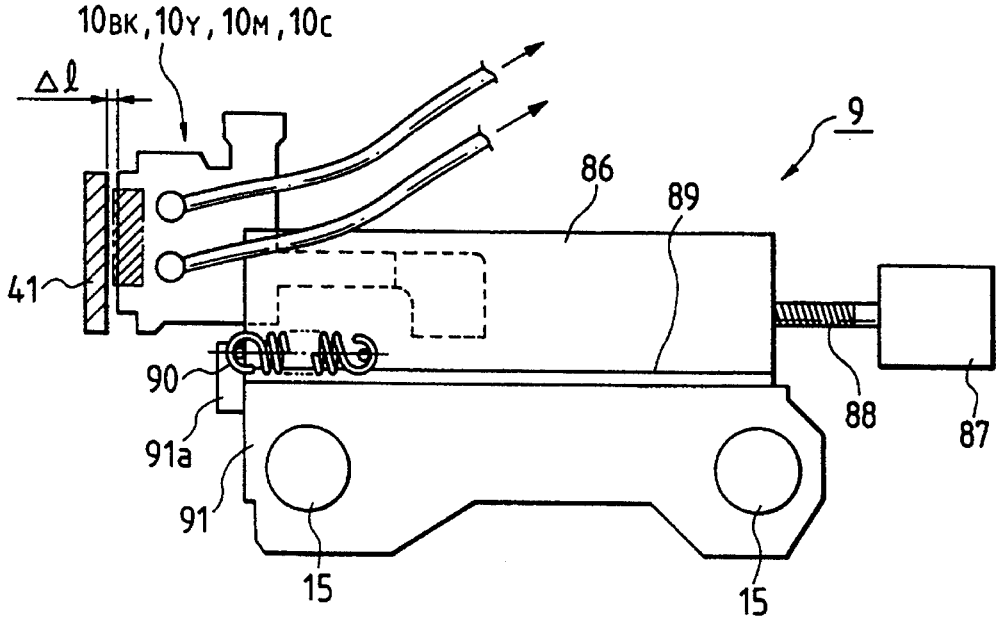
FIGS. 3A and 3B show a recording state and a waiting state respectively of the carriage in FIG. 2.
Figure 3B:
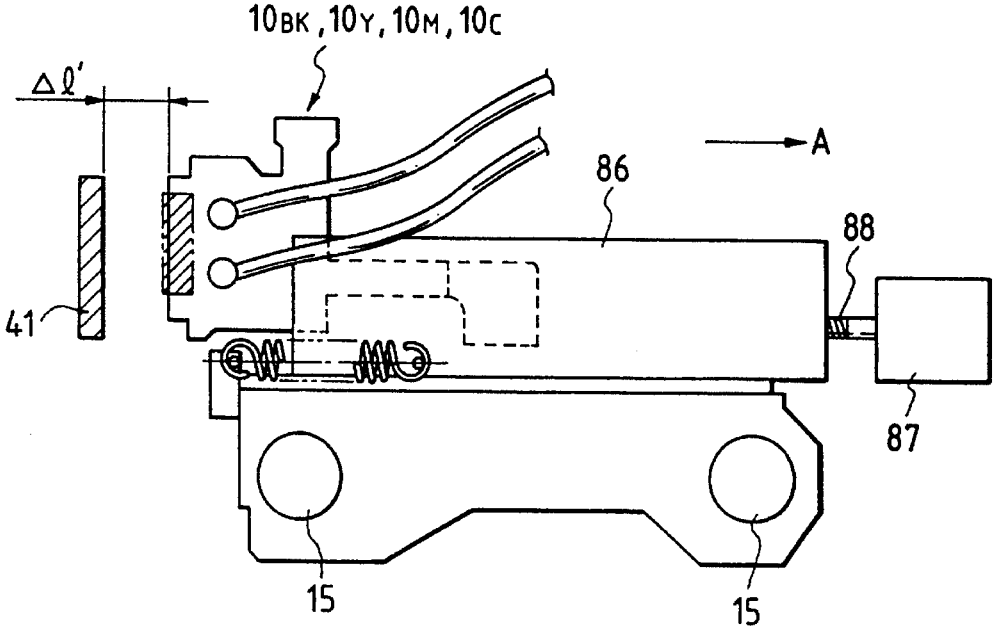

FIGS. 3A and 3B show a composition of a carriage in FIG. 2, where FIG. 3A is a recording state while FIG. 3B is a retracted state. The carriage 9 is supported by a pair of main-scanning rails 15, and is roughly divided into a moving section 91 moving on the main-scanning rail 15 and a head unit 86 for holding the recording heads 10BK, 10Y, 10M and 10C. The moving section 91 is provided with a rail 89 which supports the head units 89 movably in the left and right direction of the drawing. A sprint 90 for biasing the head unit 86 in the left hand direction in the drawing is provided between the head unit 86 and the moving section 91. The moving section 91 includes a stopper **91*a* which comes to contact with an end of the head unit 86 to maintain a gap 1 between the each of the recording heads 10C, 10M, 10Y and 10BK and the platen 41 at an amount suitable for recording. A motor 87 for moving the head unit 86 and having an output shaft coupled to a feeding screw 88 rotates the feed screw 88 to drive the head unit 86** in the right-left direction of the drawing.

As shown in FIG. 3B, the gap $\Delta 1'$ between each of the recording heads 10C, 10M, 10Y and 10BK and the platen 41 increases as the head unit 86 is moved toward the direction A in the drawing, so that neither rubbing of the recording heads 10C, 10M, 10Y and 10BK with the recording medium or collision of the same with the end of the recording medium would occur.

Figure 4:
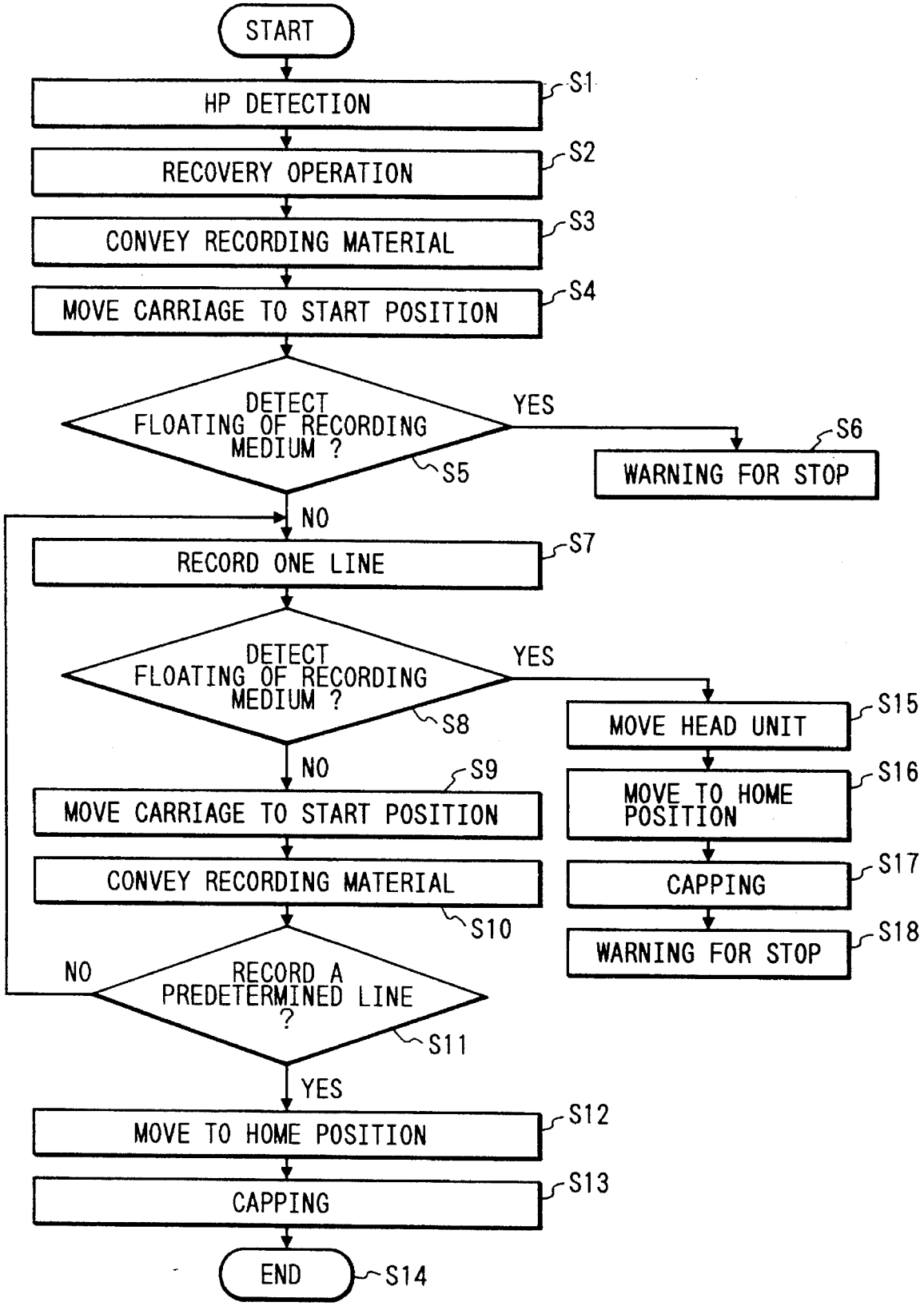
FIG. 4 is a flow diagram showing an operation sequence of the recording apparatus in FIG. 1.

The operation sequence of the present invention will now be described with reference to FIG. 4.

Firstly, the carriage 9 and the ink supplying system 11 are moved to a home position (hereinafter referred to as HP) for the initial positioning (S1), and the discharging ports of the recording heads 10C, 10M, 10Y and 10BK are covered by the recovery device 20 for performing the discharging recovery process (S2).

Subsequently, the recording medium is conveyed by the roll 2 of the cassette 7, and when the recording medium is detected by a recording detecting sensor (not shown) disposed just before the conveying roller 5, the conveying roller 5 and the sub-scanning roller 6 in the conveying path are driven until the distal end of the recording medium reaches the sub-scanning roller 6 (S3). The carriage 9 and the ink supplying system 11 are driven by the motors 69 and 70 respectively in the scanning direction (right side of FIG. 2) to the initial position.

Then a floating detecting means functions to detect if a floating phenomenon of the recording medium on the platen 41 which is an example of the abnormality in conveying the recording medium may be detected by the floating detecting means (S5), and if any drawing is detected the operation is stopped and an alarm display is carried out (S6).

On the other hand, if no floating of the recording medium is detected, the carriage 9 and the ink supplying system 11 are driven by the motors 69 and 70 respectively in the scanning direction, and the recording heads 10C, 10M, 10Y and 10BK record on the basis of the image signal with a recording width designated by the numeral 1 in FIG. 2 (S7). After recording one line, any floating of the recording medium on the platen 41 is detected in the same manner as S5 (S8). If no floating is present, the carriage 9 and the ink supplying system 11 are driven to return to the initial position (S9) while the recording medium is accurately conveyed in accordance with the recording width 1 (S10).

After executing (S11) predetermined cycles of the sequence of the aforementioned processes, recording (S7)—floating detection (S8)—carriage moving (S9)—conveying recording medium (S10), the carriage 9 and the ink supplying system 11 are moved to the HP (S12) and the recording head nozzle surface is covered by a cap member of the recovery device 20 so as to finish the recording operation.

When any floating of the recording medium is detected in S8, the head unit 86 is retracted from the recording medium to expand the gap between the recording medium and the recording heads 10C, 10M, 10Y and 10BK (S15). Thereafter, the carriage 9 and the ink supplying system 11 are moved to HP (S16) and the discharge port of the recording head is covered by a cap member of the recovery device 20 (S17) so as to display the stopping alarm (S18).

In the operation sequence described with reference to FIG. 4, when any floating of the recording medium (cloths) from the conveying belt (platen) is detected in step S5 or S8, the recording operation is stopped.

Another embodiment, in which whether the recording operation (carriage moving) is to be continued or not is determined depending on the distance (floating amount) between the recording medium and the head or the floating angle of the recording medium from the platen by using a detecting means for detecting the variation of the floating amount of the recording medium along the main-scanning direction of the carriage, while keeping the distance between the head and the recording medium constant, will not be described. The control operation for maintaining the distance between the head and the recording medium constant is the same as in the previous embodiment, so the description for this embodiment will be focused on the operation sequence for determining whether the recording operation (carriage moving) is to be continued or not on the basis of the floating amount and the floating angle.

Figure 20:
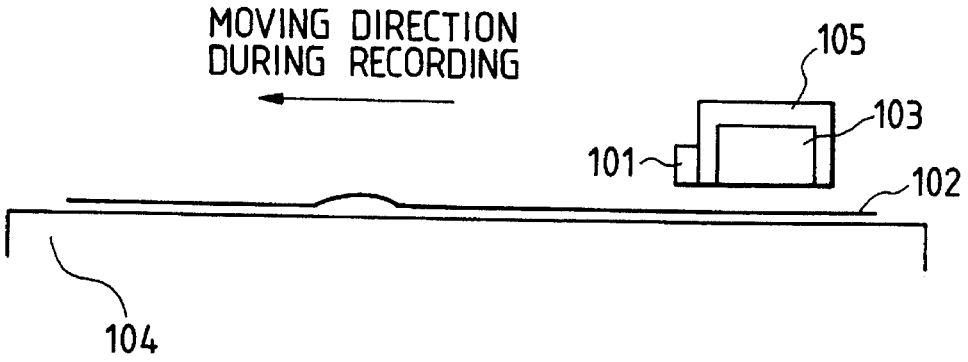
FIG. 20 is a schematic view showing a composition of a carriage of another embodiment of the present invention.

As shown in FIG. 20, an ultrasonic sensor 101 (or optical sensor) is mounted on the carriage 105 directing to the direction of the recording member 102 as a detecting means for measuring the variation of the floating amount of cloths as a recording medium along the main-scanning direction of the carriage 105. The variation of the floating amount of the recording medium along the main-scanning direction of the carriage 105 in accordance with the carriage movement is measured.

Figure 21:
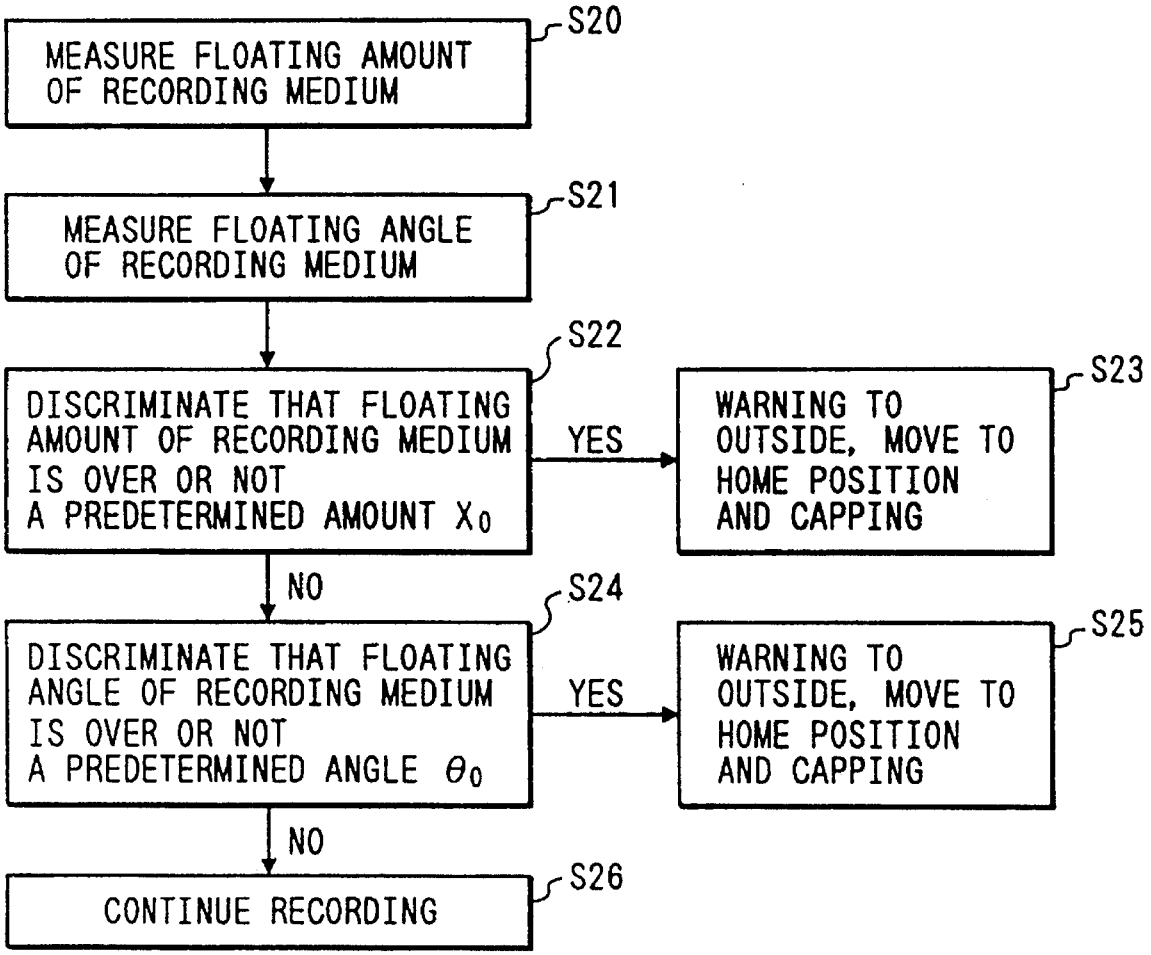
FIG. 21 is a flow diagram showing another operation sequence of the present invention.

The actual operation at this time will be described with reference to a block diagram of FIG. 21. As the carriage 105 is moved in the main-scanning direction, the ultrasonic sensor 101 measures and records the floating amount of the recording medium 102 in front of the recording direction of the ink jet recording section 103 from the platen 104 (S20). Alternatively, it is also possible to make the carriage 105 scan once to measure only the floating amount of the recording member 102 and store the measured data in the control section.

Next, the floating amount data between contiguous measuring points among several measuring points for the floating amount in the main-scanning direction are compared to each other to provide a floating angle of the recording medium 102 from the platen 104 (S21).

Subsequently, it is judged if the floating amount of the recording medium exceeds a predetermined amount X0 in step S22 (see FIG. 22A). If the measured floating amount X1 exceeds the predetermined amount X0, it is warned externally in S23 and the carriage is returned to HP and the head is covered by the cap. On the other hand, if the measured floating amount X2 is equal to or less than the predetermined amount X0, the process shifts to S24 where it is judged if the measured floating angle exceeds a predetermined floating angle.

In S24 if the measured floating angle $\theta_1$ exceeds the predetermined angle $\theta_0$, it is warned externally in S25 and the carriage 105 is returned to the HP and the head is covered by the cap. Meanwhile, if the measured floating angle $\theta_1$ is equal to or less than the predetermined angle $\theta_0$, the recording operation on the recording medium is performed in S26.

The predetermined floating amount X0 is determined basically from correlation of the main scanning speed of the carriage 105 and the moving speed of the head in the direction of separating from the recording medium. Namely, the predetermined amount X0 must be a value for enabling the head to be retracted without contacting with the recording medium.

Further, the predetermined floating angle $\theta_0$ is determined properly from a distance between the head and the recording medium (normally about 1 mm) and the magnitude of the head, and further from a contiguous head gap (space between contiguous rows of the discharging ports) in case of several heads. For example, even for the same floating amount X2, the curve R1 in FIG. 22B is improper because of undesirably affecting the recording quality (the recording image deviates in the main-scanning direction), while the curve R2 is proper to continue the recording operation without stopping because of the gentle gradient not substantially degrading the recording quality. The optimum predetermined floating angle $\theta_0$ should be determined in view of above conditions.

According to such a sequence, an excellent effect can be obtained when a recording operation is applied on a continuous sheet or a long cloth particularly when an unmanned recording operation is carried out, securely preventing the head from damage by the collision with the recording medium while maintaining a desirable recording quality.

Figure 5:
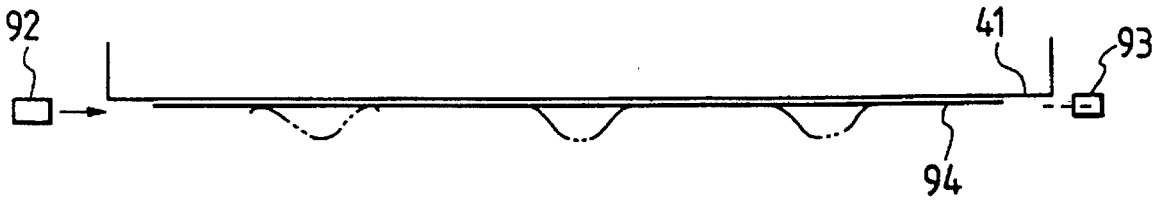
FIG. 5 is a diagram showing a positional relationship of light emitting/receiving units in FIG. 2 with respect to the platen.

Next, the floating detecting means for detecting the floating of the recording medium will be described in detail with reference to FIG. 5.

The light emitting unit 92 comprises a light emitter such as an LED or a semiconductor laser and the like for emitting light toward the light receiving unit 93. The light receiving unit 93 comprises a photoelectric converting element such as a photodiode to receive light from the light emitting unit 92.

When the recording medium 94 is closely attached to the platen 41 without any floating therefrom, the light emitted from the light emitting unit 92 will directly reach the light receiving unit 93 without being subject to any interception. On the other hand, when any floating occurs for the recording medium 94 as shown by an alternate long and short dash line in the drawing, the light from the light emitting section 92 is intercepted by the recording medium 94, thereby detecting the floating of the recording medium 94. Also, it is possible to double such a detecting means.

Figure 6:
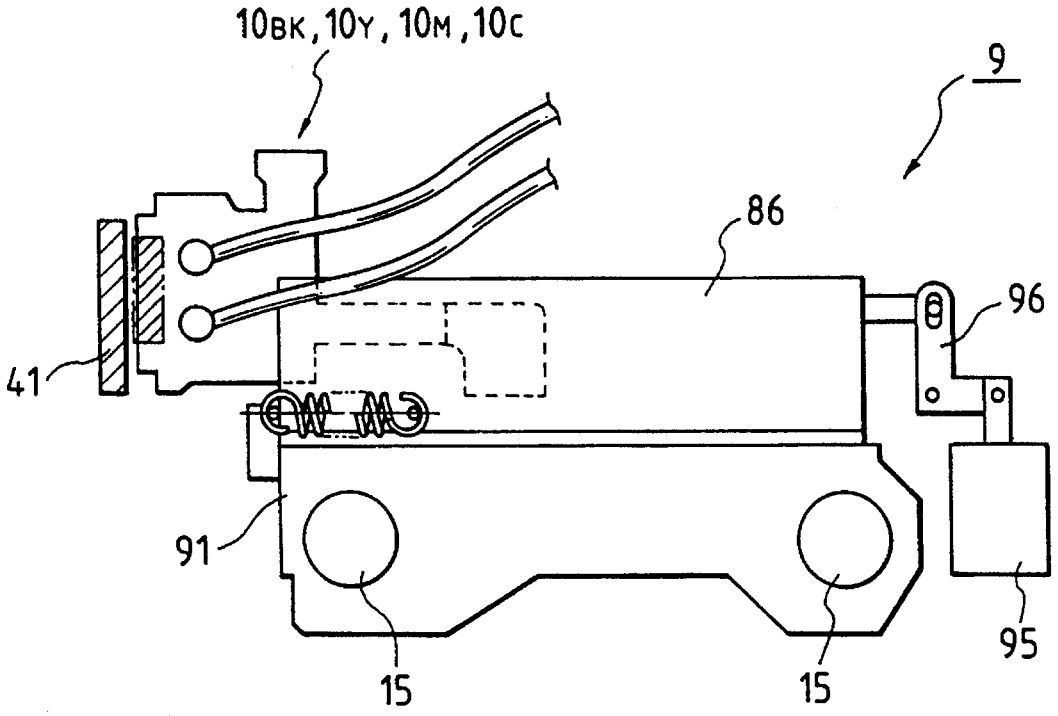
FIG. 6 is a diagram showing a composition of a carriage of a recording apparatus according to another embodiment of the present invention.
Figure 7A:
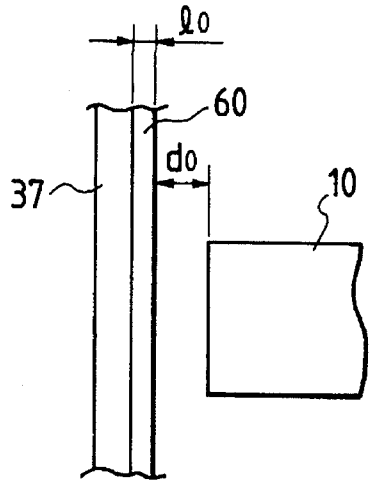
FIGS. 7A, 7B and 7C show cases of thin cloths, cloths of intermediate thickness and thick cloths respectively, in a schematic view representing a positional relationship between cloths of various thickness and the recording head in a dyeing apparatus using the recording apparatus of the present invention.
Figure 7B:
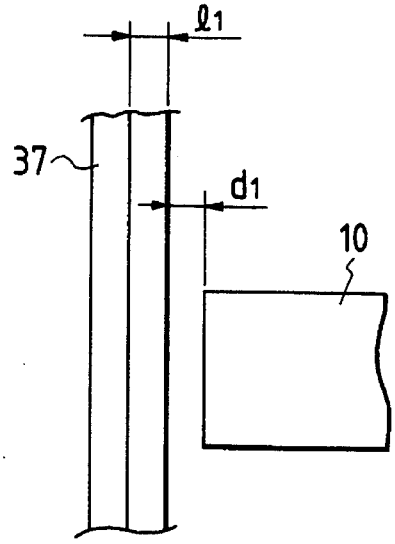
Figure 7C:
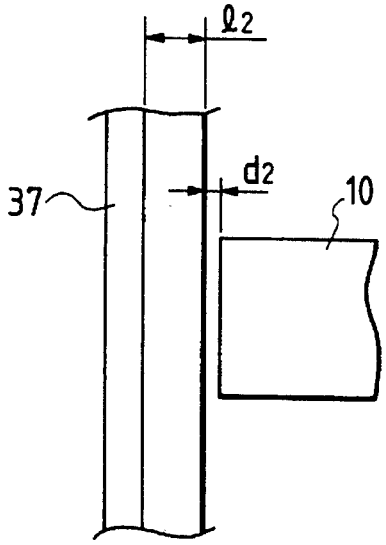
Figure 8:
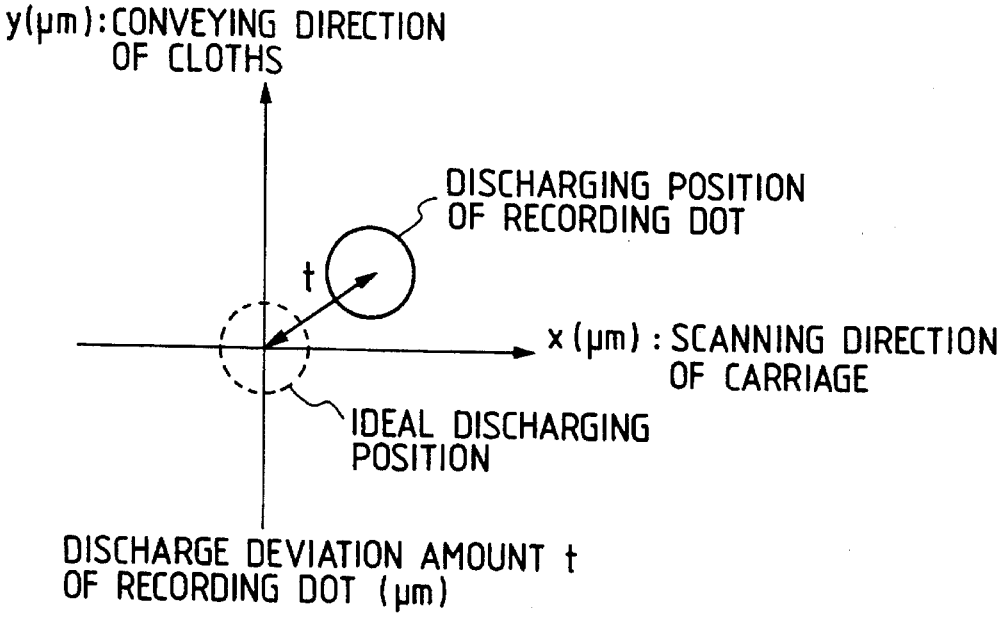
FIG. 8 is a graphic diagram representing a discharge deviation of the recording dot.
Figure 9:
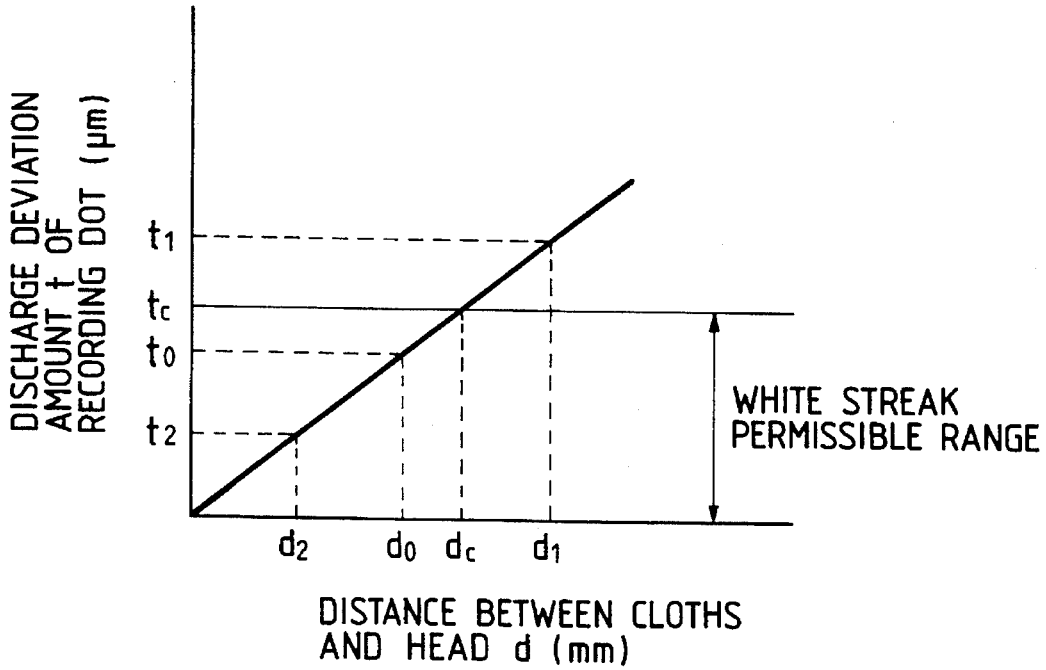
FIG. 9 is a graphic diagram showing a relationship between the distance between the cloths and the recording head and the discharge deviation amount of the recording dot.

In the present embodiment, the means for moving the carriage 9 has been composed of the motor 88 and the feeding screw 87 as shown in FIG. 3, but alternatively it is also possible, not limited thereto, to compose it of a solenoid 95 and a link 96 as shown in FIG. 6 such that the carriage 9 is moved toward the right-hand direction of the drawing by the attracting force of the solenoid 95 so as to vary the gap between the recording heads 10C, 10M, 10Y and 10BK and the platen 41.

Also, the floating means for detecting the floating of the recording medium is not limited to that shown in the present embodiment, and can be composed of an air pump for absorbing or attracting the recording medium to the platen in which the floating is detected on the basis of the variation of the attracting pressure of the air pump.

Figure 15:
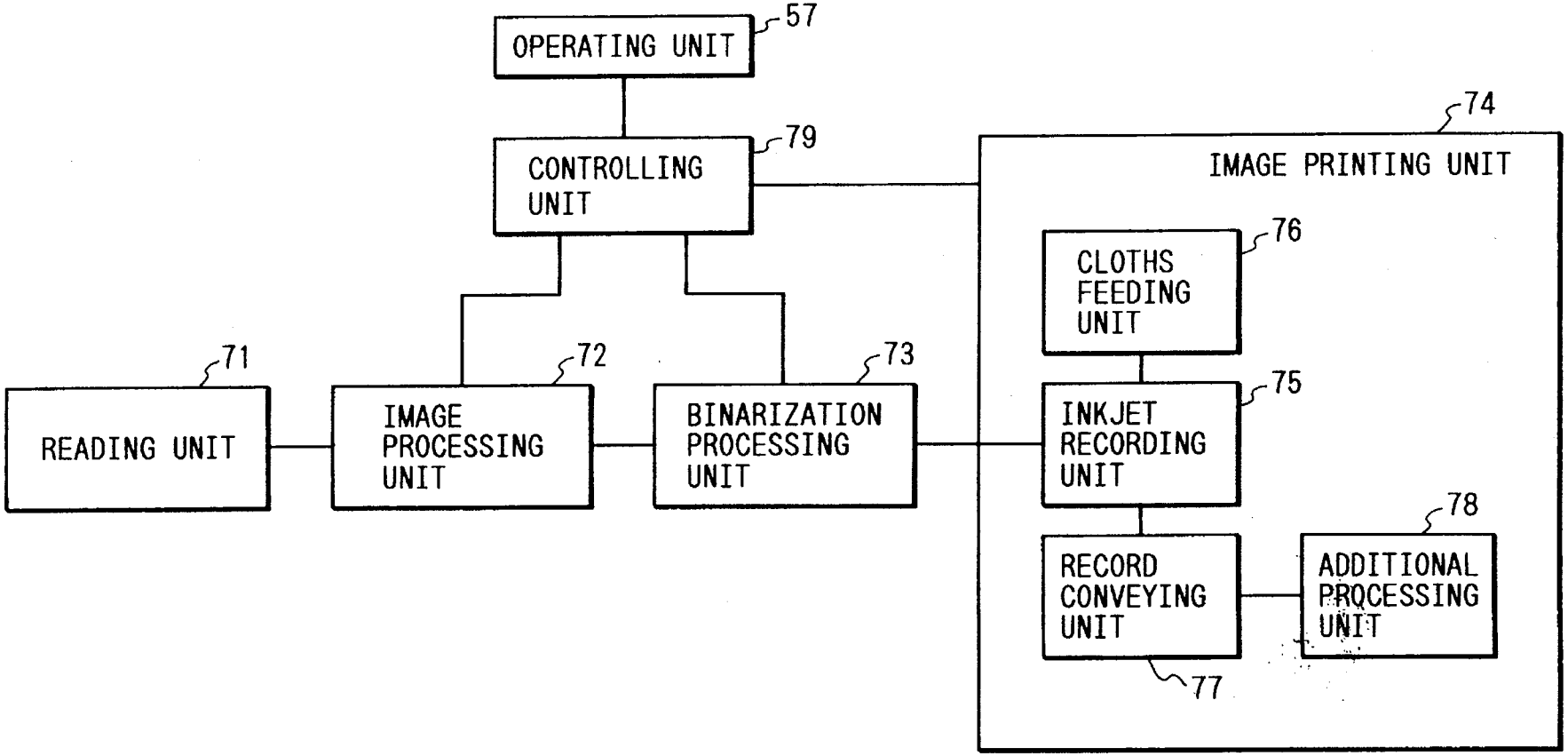
FIG. 15 is a diagram showing a composition of a dyeing system using a recording apparatus of the present invention.

A dyeing system incorporating the ink jet recording method using cloths as a recording medium will now be described with reference to FIG. 15 schematically showing an example of such a system composition.

This system is roughly composed of a reading unit 71 for reading an original image made by a designer, for example, an image processing unit 72 for processing original image data read out by the reading unit 71, a binarization processing unit 73 for converting image data produced in the image processing unit 72 into binary data, and an image printing unit 74 for printing on the cloths on the basis of the binary image data processed in the binary processing unit 73. In the reading unit 71, the original image is read out by a CCD image sensor and is output to the image processing unit 72 as electrical signals. In the image processing unit 72, driving data for driving an ink jet recording unit 75 for discharging four colors of inks, cyan, magenta, yellow and black mentioned later are created from the input image data. Creating such data includes processes of: image processing for recovering the original image by ink dots; coloring for determining the color tone; change of lay-out; and selection of the magnitude of the image such as scaling up and down. The image printing unit 74 is composed of an ink jet recording unit 75 for discharging ink on the basis of the driving data, a cloths feeding unit 76 for feeding the cloths as a recording medium to the ink jet recording unit 75, a record conveying unit 77 for accurately conveying the cloths disposed to face the ink jet recording unit 75, and an additional (post)-processing unit 78 for post-processing and storing the cloths having been recorded.

Next, the ink jet recording unit 75 will be described.

Figure 16:
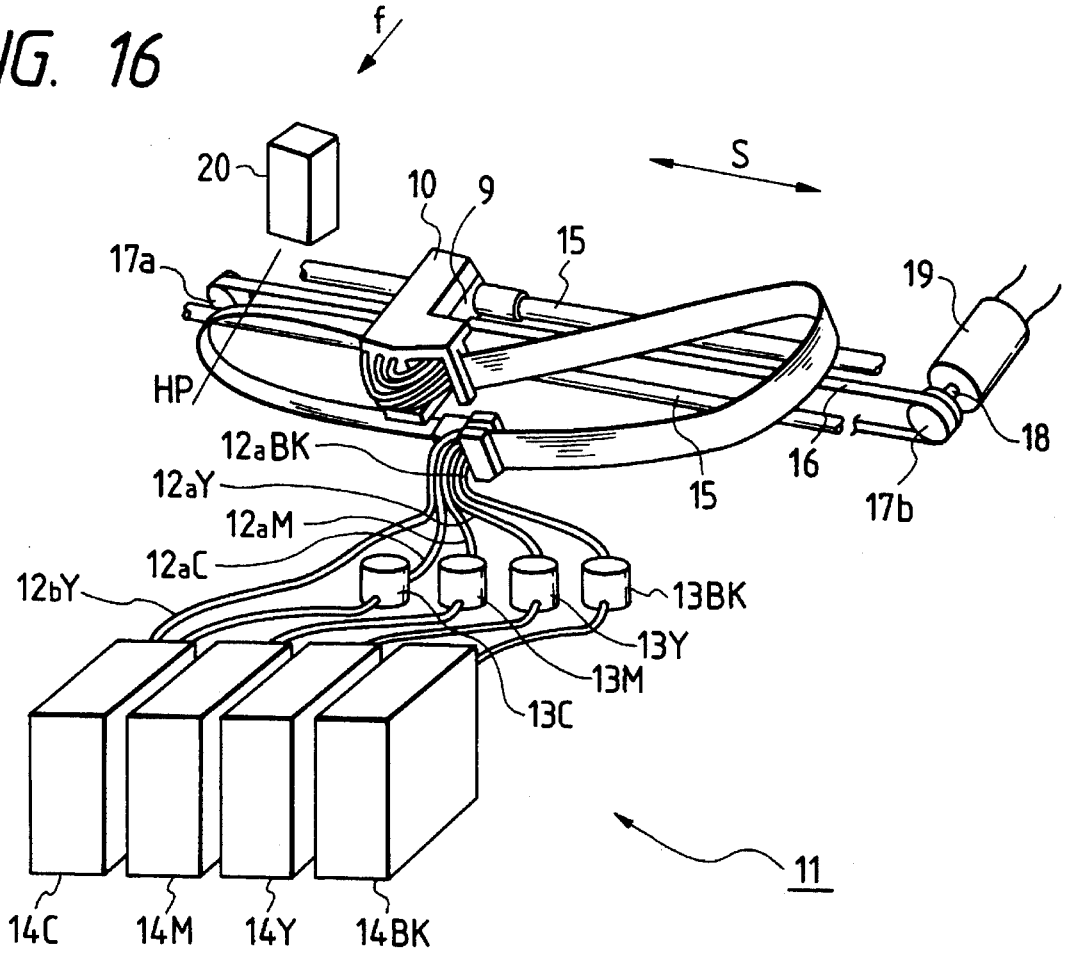
FIG. 16 is a schematic perspective view of the ink jet recording unit shown in FIG. 15.

The ink jet recording unit 75 is roughly composed of, as shown in FIG. 16, a carriage 9 supported movably in the arrow S direction by a pair of main-scanning rails 15, a recording head 10 mounted on the carriage 9, an ink supplying system 11 for supplying ink to the recording head 10, a recovery device 20 for processing to recover the discharging of the recording head 10, and an electronic system not shown.

The ink supplying system 11 is for storing ink and supplying necessary amount thereof to the recording head 10, and includes four ink tanks 14C, 14M, 14Y and 14BK for receiving inks of cyan, magenta, yellow and black respectively, and four pumps 13C, 13M, 13Y and 13BK for supplying the inks from the ink tanks 14C, 14M, 14Y and 14BK to the recording head 10. The ink tanks 14C, 14M, 14Y and 14BK and the recording heads 10 are coupled by tubes 12*a*C, 12*a*M, 12*a*Y, 12*a*BK and 12*b*Y respectively, and normally only an amount to be discharged from the discharge port of the head by the capillary effect is supplied automatically to the recording head 10. Further, on the head recovery operation as mentioned later, the inks are forcibly supplied to the recording head by pumps 13C, 13M, 13Y and 13BK.

The recording heads 10 and a part of the ink supplying system 11 are mounted on the carriage 9. The carriage 9 is fixed to a part of a belt 16 provided between a pulley 17*a* and a pulley 17*b* secured to a shaft 18 of a motor 19, so as to reciprocate in the arrow S direction along the main-scanning rail 15 in accordance with the rotation of the motor 19.

The recovery device 20 is disposed to face the recording head 10 at the home position HP for stabilizing the discharging property of the head. The recovery device 20 functions specifically as follows: capping the recording head 10 at HP for preventing evaporation of the inks from the flowing path by moving the head 10 forwardly in the arrow f direction when not operating (capping operation); and receiving discharged inks when the inks are forcibly discharged through the nozzle by applying a pressure to the ink-flowing path in the head by using an ink pump for eliminating bubbles and dusts therein before starting the image recording operation (pressure recovery operation), etc.

Figure 17:
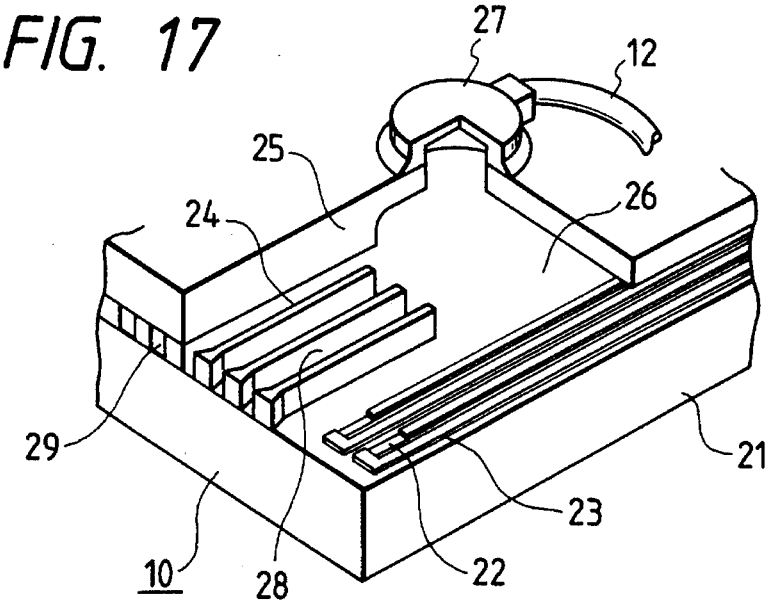
FIG. 17 is an essential perspective view showing a cutout part of the recording head shown in FIG. 16.

FIG. 17 is a perspective view showing a schematic composition of the recording head 10, which is composed of an electrothermal converter 22, an electrode 23, a flowing path wall 24, and a roof plate 25 formed on a substrate 21 through semiconductor manufacturing processes such as etching, evaporation, sputtering, etc.

The recording ink is supplied from the ink tank 14 (see FIG. 16) through a tube 12 (see FIG. 16) into a common liquid chamber 26 of the recording head 10. The numeral 27 designates a supplying tube connector.

The ink having been supplied to the common liquid chamber 26 is fed to the flow path 218 by the capillary effect, and stably maintained by forming a meniscus by the discharge port surface 29 of the nozzle end. By energizing the electrothermal converter 22, the ink thereon is heated to generate a bubbling phenomenon, the energy of which leads to discharge of ink drops from the discharge port surface 29.

With above-mentioned composition, it is possible to manufacture the multi-nozzle type ink jet recording head 10 having 128 or 256 nozzles in a high density discharge port arrangement of discharge ports spaced at 16/mm, for example.

Figure 18:
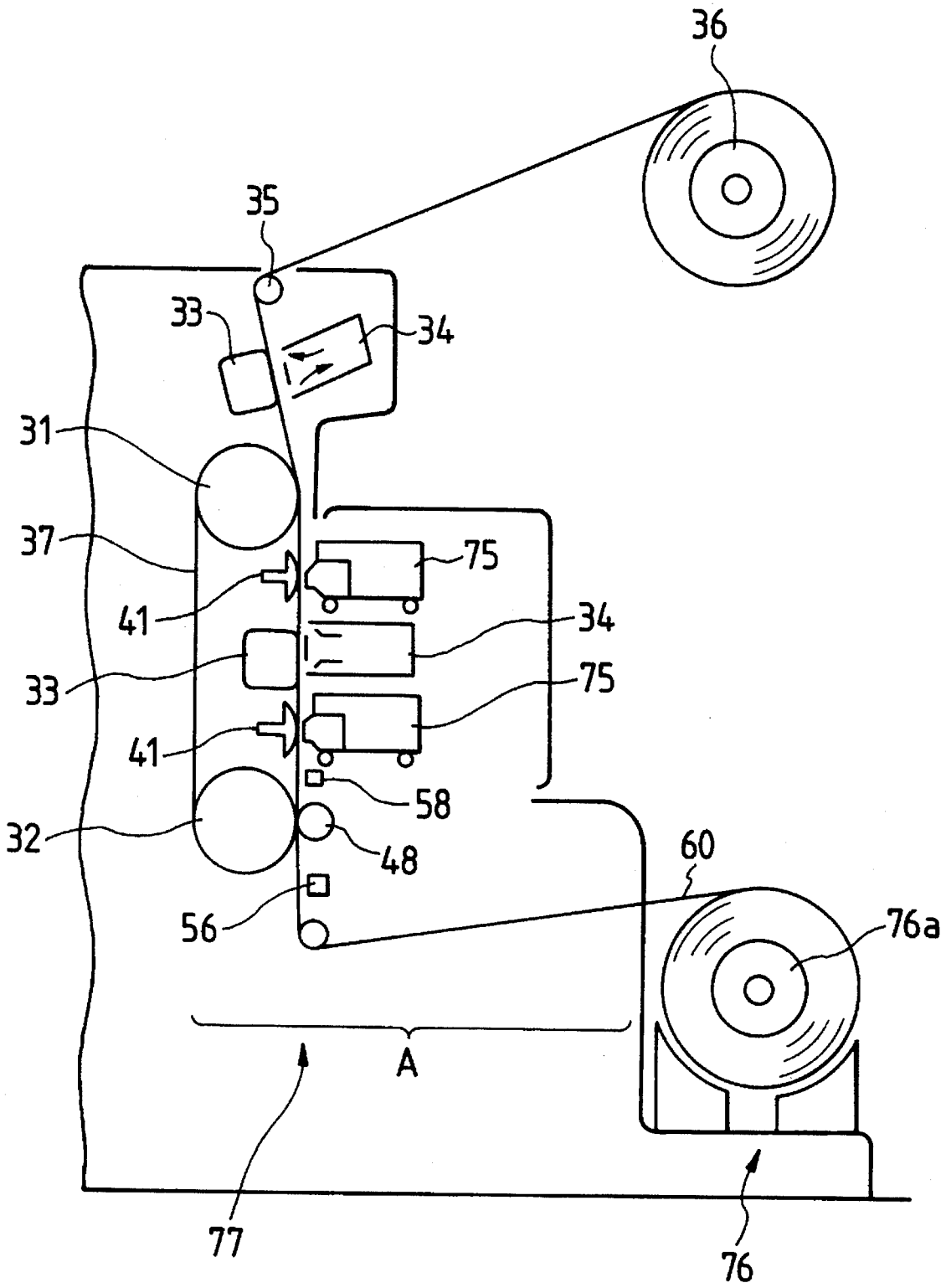
FIG. 18 is a schematic view showing a composition of a dyeing apparatus in an image printing unit of the dyeing system shown in FIG. 15.
Figure 19:
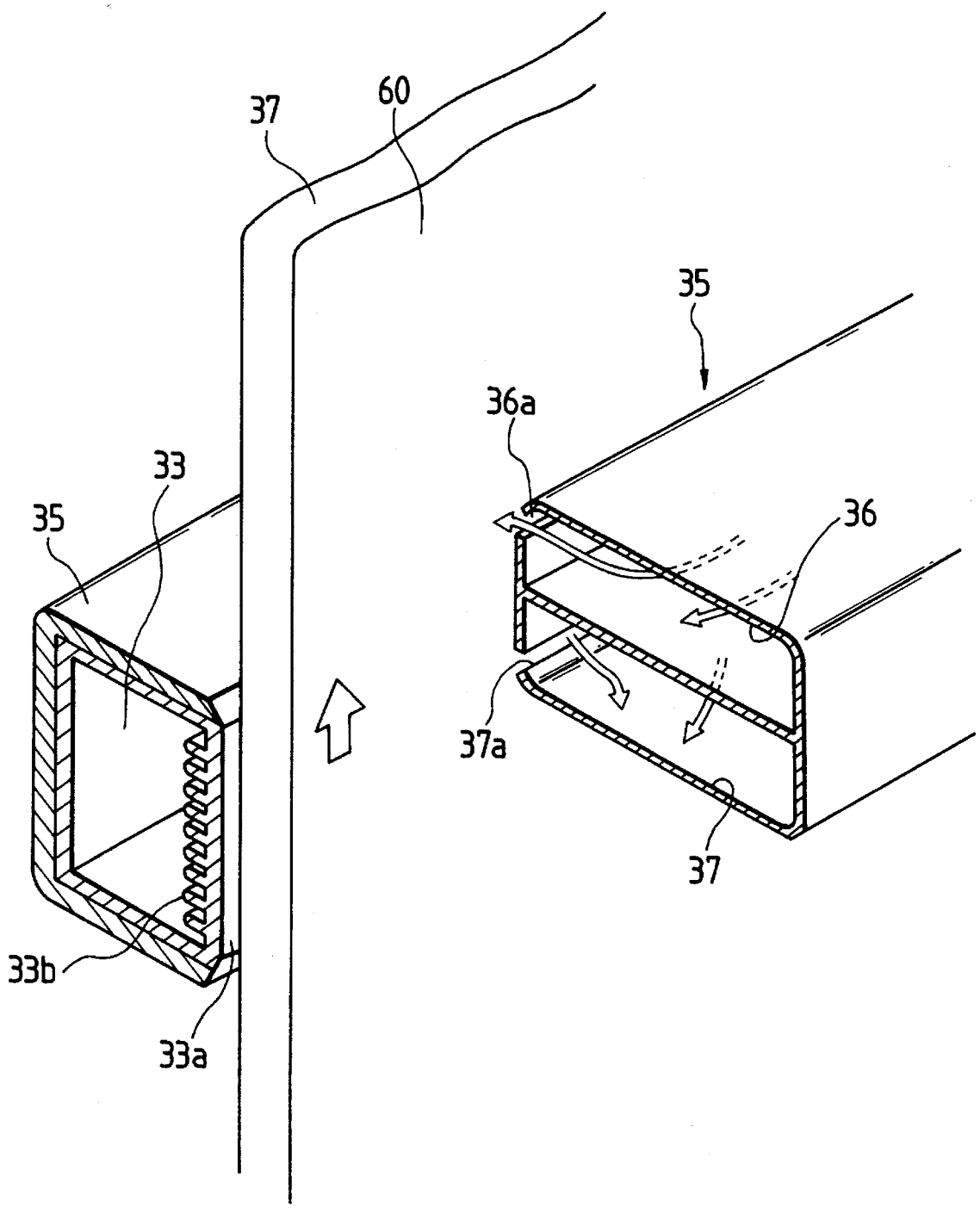
FIG. 19 is an essential enlarged perspective view of the dyeing apparatus shown in FIG. 18.

FIG. 18 is a schematic view showing a composition of a dyeing apparatus in the image printing unit 74 shown in FIG. 15, and FIG. 19 is its essentially enlarged perspective view. The dyeing apparatus includes a cloth feeding unit 76 and an image or record conveying unit 77 of the image printing unit 74, and record conveying unit 77 has two ink jet recording units 75 for sequentially recording on the cloth 60.

A pre-processed cloth 60 is wound around a winding core 76*a* in a roll-shape and rotatably supported by the cloth feeding unit 76 where it is supplied to the record conveying unit 77. In the record conveying unit 77, an endless conveying belt 37 accurately driven in steps is fitted to the driving roller 31 and the winding roller 32. The driving roller 31 is directly driven in steps by a high-resolution stepping motor (not shown) to feed the conveying belt 37 only by the stepping amount. Thus fed cloth 60 is pressed and adhered by the pressing roller 48 to the surface of the conveying belt 37 supported by the winding roller 32.

The cloth 60 having been fed in steps by the conveying belt 37 is subject to the printing operation at its front side being fixed by the platen 41 located at the rear side of the conveying belt 37 in the first ink jet recording section 75. After completing the recording operation for each line, the cloth is fed in steps by a predetermined amount, and then dried by heat supplied from a heating plate 33 at the rear side of the conveying belt 37 and blown, heated air from the front surface side supplied through a heated air duct 34. Subsequently, the cloth receives an overlapping recording operation at the next ink jet recording unit 75 in the same manner as in the first ink jet recording unit 75.

The cloth having been subjected to overlapping recording is then stripped off of the conveying belt 37 and dried again by the heating plate 33 provided at the downstream side of the driving roller 31 and by the heated wind duct 34, and conducted by the guide roller 35 to be wound around the winding roller 36. The thus wound cloth 60 is removed from the apparatus, and subjected to post-processing including coloring, washing and drying in batch process so as to be completed as a product.

The heating plate 33 and the heated air duct 34 will now be described with reference to FIG. 19. A heat conducting surface 33*a* of the heating plate 33 is pressed to the rear surface of the conveying belt 37 to which a strong tension is applied, such that the conveying belt 37 is strongly heated from its rear side by a stream of high temperature and high pressure having been supplied to the hollow inside thereof. Then, the conveying belt 37 would directly and effectively heat the cloth 60 which is adhered to its surface, by the heat conductivity. A fin 33*b* is provided for collecting heat at the inside of the heat conducting surface 33*a* of the heating plate 33 to efficiently concentrate the heat to the rear surface of the conveying belt 37. The side not in contact with the conveying belt 37 is covered by a heat insulating material to minimize the loss by the heat radiation.

On the other hand, the heated air duct 34 disposed at the front surface side of the cloth is composed by an integrated supplying duct having a discharge port 36*a* facing the cloth 60 and an absorbing duct 37 having an absorbing opening 37*a* facing the cloth 60. The supplying duct 36 is located at the downstream side of the absorbing duct 37 in the conveying direction of the cloth 60, so that air of less humidity is applied to the cloth 60 which is being dried by blowing out of the drying heated air from the supplying duct 36 for enhancing the drying effect. The drying heated air having been blown out from the supplying duct 36 flows in the reverse direction of the conveying direction of the cloth 60 and is absorbed after containing the humidity on the cloth 60 by the absorbing duct 37. It is prevented that the evaporated humidity leaks to form dew on the peripheral machines by absorbing a significantly larger amount than the blown out amount. The source of the drying heated air is disposed at the inner side of FIG. 19 while the absorption is done at the front side, such that the pressure difference between the blowing out opening 36*a* and the absorbing opening 37*a* becomes uniform over the entire area along the longitudinal direction. Further, since the heated air duct 34 is offset to the downstream side of the conveying direction of the cloth 60 from the center of the heating plate 33, the heated air blows on a sufficiently heated part. By virtue of such a composition, the great amount of humidity in the inks containing a diluted solution received by the cloth 60 on recording by the ink jet recording section 75 can be effectively dried.

Although the length of the cloths 60 is finite, it is also possible to continue recording by seaming the last end of the cloth 60 with an end of another cloth when it comes out of the winding core 76*a*. For this end, a colored seaming thread is used and a density detecting sensor 56 is provided at the upstream side of the pressing roller 48 in the conveying direction of the cloth 60. When the seamed portion is detected by the density detecting sensor 56, the recording operation is temporarily stopped on the seamed portion coming just before the first ink jet recording unit 75. Thereafter, the cloth 60 is fed by a predetermined amount until the seamed portion comes to just below the downstream side of the ink jet recording unit 75 to restart the recording. Thus, even if the thickness of the cloth 60 increases due to the seaming, the recording head 10 of the ink jet recording unit 75 (FIG. 16) does not contact with the seamed portion so as to prevent the cloth 60 from being stained and the recording head 10 from being damaged.

Next, another case of a thickness detecting means for the recording medium will be described with reference to a cloth thickness detecting means for automatically detecting the thickness of the cloth in the aforementioned dyeing apparatus.

Figure 10A:
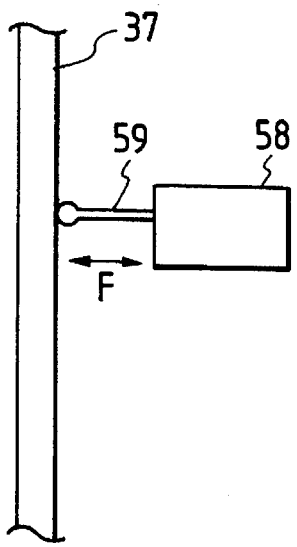
FIGS. 10A and 10B show states of contact pins when the cloths are present and absent respectively, for the explanation of the operation of the cloth thickness detecting means of the dyeing apparatus incorporating the recording apparatus of the present invention.
Figure 10B:
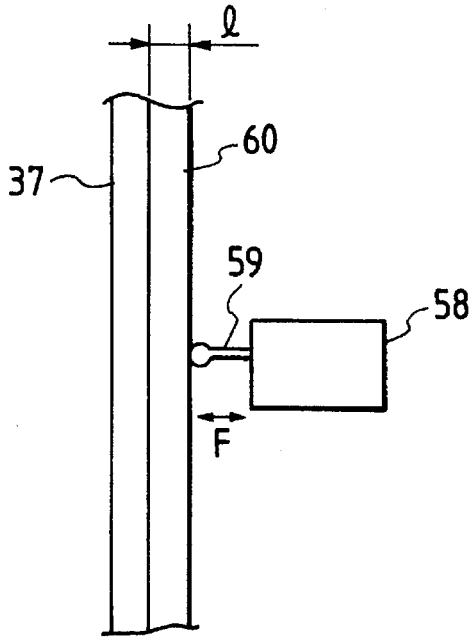

FIG. 10 is a model diagram suitable for the explanation of the cloth thickness detecting operation according to the present embodiment. In this embodiment, a cloth thickness detecting means 58 having a contact pin 59 movable in the arrow F direction is provided at the downstream side of the pressing roller 48 (FIG. 18). The contact pin 59 contacts with the conveying belt 37 when no cloth 60 is present at a position facing the cloth thickness detecting means 58. Thereafter, as shown in FIG. 10B, the cloth 60 is conveyed to a position facing the cloth thickness detecting means 58 by the conveying belt 37 so as to contact the contact pin 59 with the cloth 60 on the conveying belt 37, thereby measuring the thickness 1 of the cloth 60.

After the thickness 1 of the cloth 60 on the conveying belt 37 is automatically detected, the distance between the surface of the cloth 60 and the recording head 10 is automatically set to an optimum value.

The operation to set the distance between the cloth 60 and recording head 10 to an optimum value using a signal detected by the cloth thickness detecting means 58 will now be described.

Figure 11:
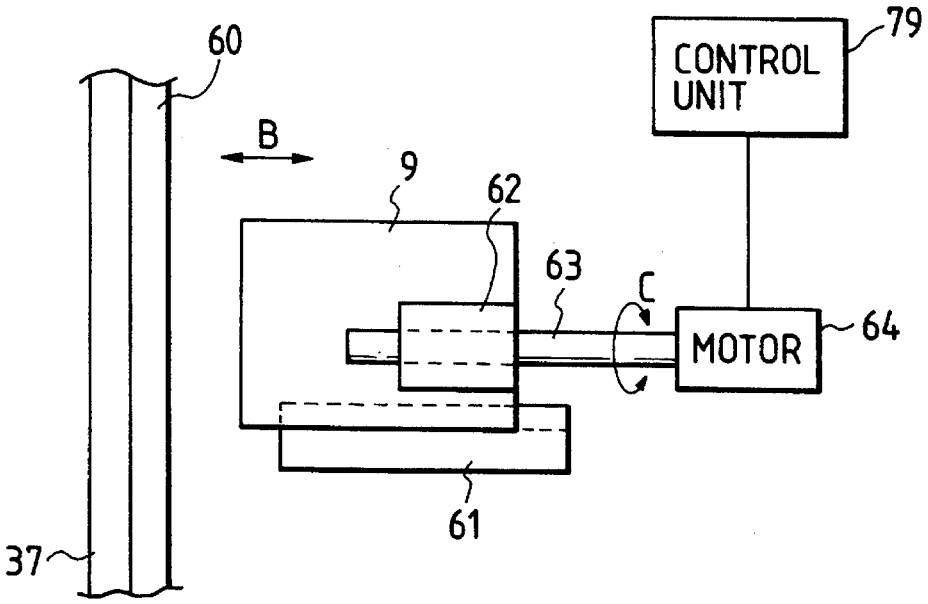
FIG. 11 is a schematic view showing a composition of a carriage of a dyeing apparatus incorporating a recording apparatus according to the present invention.

FIG. 11 is a schematic view showing a composition that the carriage 9 mounting the recording head 10 thereon is variably movable in the direction perpendicular to the surface of the conveying belt 37 for automatically varying the distance between the surface of the cloth 60 and the recording head 10 on the basis of the signal of the cloth thickness 1 detected by the cloth thickness detecting means 58. As shown in FIG. 11, the carriage 9 having the recording head 10 mounted thereon is mounted slidably along slide rails that extend in the direction perpendicular to the conveying belt surface (arrow B direction) on the carriage base 61. The carriage 9 includes a screw member 62 to be screwed into a screw rail 63 coupled to an output shaft of the motor 64 for rotating the motor 64 in response to the order from the control unit 79 so as to move the carriage 9 in the arrow B direction.

Then, the distance between the surface of the cloth 60 and the recording head 10 is set to an optimum value by controlling the rotation of the motor by the control unit 79 on the basis of the signal of the thickness 1 of the cloth 60 detected by the cloth thickness detecting means 58, controlling the rotating amount of the screw rails 68 in the arrow C direction, and controlling the sliding moving amount of the carriage in arrow B direction perpendicular to the surface of the conveying belt.

Although in this embodiment the thickness 1 of the cloth 60 is automatically detected to set the distance between the surface of the cloth 60 and the recording head 10 to an optimum value, alternatively it is also possible to perform the setting operation by, for example, determining the thickness 1 of the cloth 60 by an operator, manually selecting a selecting switch corresponding to the thickness L of the cloth 60 in the operating unit 57 (FIG. 15), and moving the carriage 9 in the arrow B direction by driving the motor 64 in response to the selected switch signal input to the control unit 79.

Figure 12:
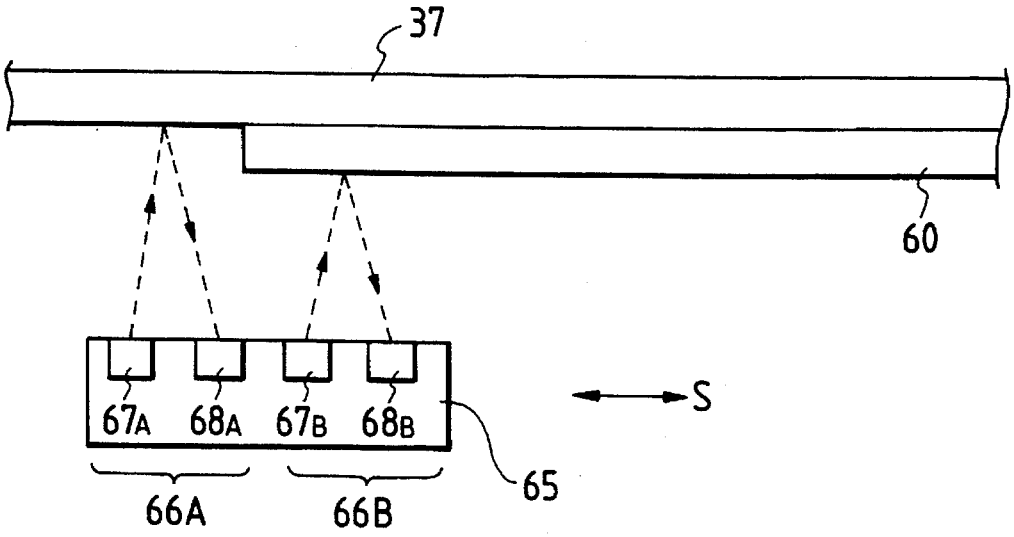
FIG. 12 is a schematic view showing an example using an optical detecting means as a cloth thickness detecting means.
Figure 13:
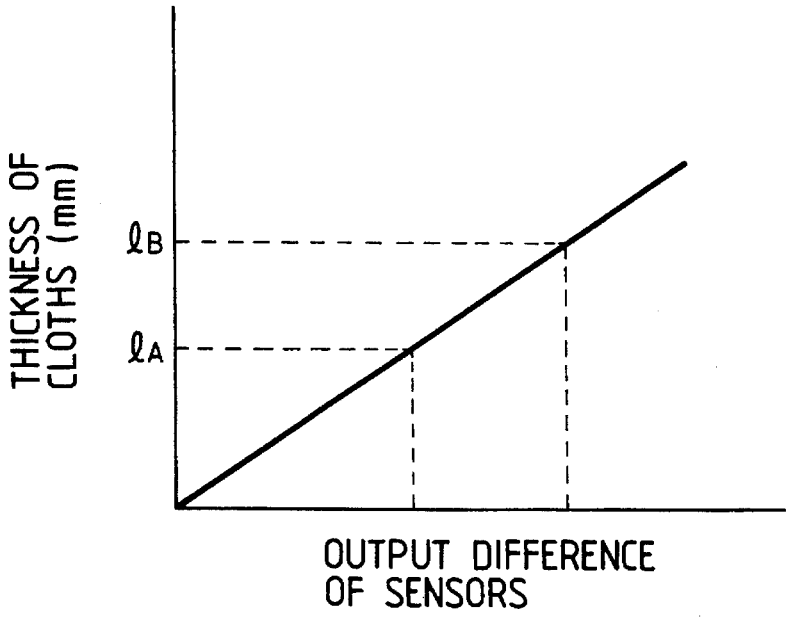
FIG. 13 is a graphic diagram showing a relationship between the sensor output difference of the optical detecting means shown in FIG. 12 and cloth thickness.

FIG. 12 is a schematic view for an example in which an optical detecting means 65 is disposed as a cloth thickness detecting means for automatically detecting the thickness of the cloth at the downstream side of the pressing roller 48 (FIG. 18) and in vicinity of the conveying belt 37. In this embodiment, the optical detecting means 65 is composed of two sets of optical sensors 66A, 66B including light emitting units 67A, 67B such as LEDs or pilot lamps and light receiving units 68A, 68B such as photodiodes, respectively. The thickness of the cloth is obtained by calculating the difference in output level between the optical sensors 66A and 66B. The output from the optical sensor 66A corresponds to a light amount having reached the light receiving unit 68A after being emitted from the light emitting unit 67A of the optical sensor 66A and reflected by the conveying belt 37. The output from the optical sensor 66B corresponds to a light amount having reached the light receiving unit 68B after being emitted from the light emitting unit 67B of the optical sensor 66B and reflected on the surface of the cloth 60. Namely, as shown in FIG. 13, there is a proportional relationship between the output difference between the optical sensor 66A, 66B and the thickness of the cloth, such that it is possible to obtain the thickness of the cloth by calculating the sensor output difference.

Further, as mentioned in the present embodiment, the thickness of the cloth can be detected without any contact, thereby avoiding any mechanical damage on the surface of the cloth.

Although in the present embodiment the optical detecting means 65 has been composed of two sets of optical sensors 66A, 66B, alternatively it is also possible to compose it of one set of a light emitting unit and a light receiving unit and to move this optical detecting means 65 in the direction parallel to the scanning direction (S direction) of the carriage 9 mounting the recording head 10 thereon for measuring the reflected light amount to calculate the thickness of the cloths. Further, although in this embodiment the light amount reflected on the conveying belt 37 and the cloth 60 is detected by the light receiving unit, it is also possible, for example, to compose the light emitting unit of a semiconductor laser, for example, to emit a pulse-like light beam from the light emitting unit to the conveying belt 37 and the cloth 60, and to detect the thickness of the cloth from the difference in time that the reflected pulse-like light beam reaches the light receiving unit.

Figure 14A:
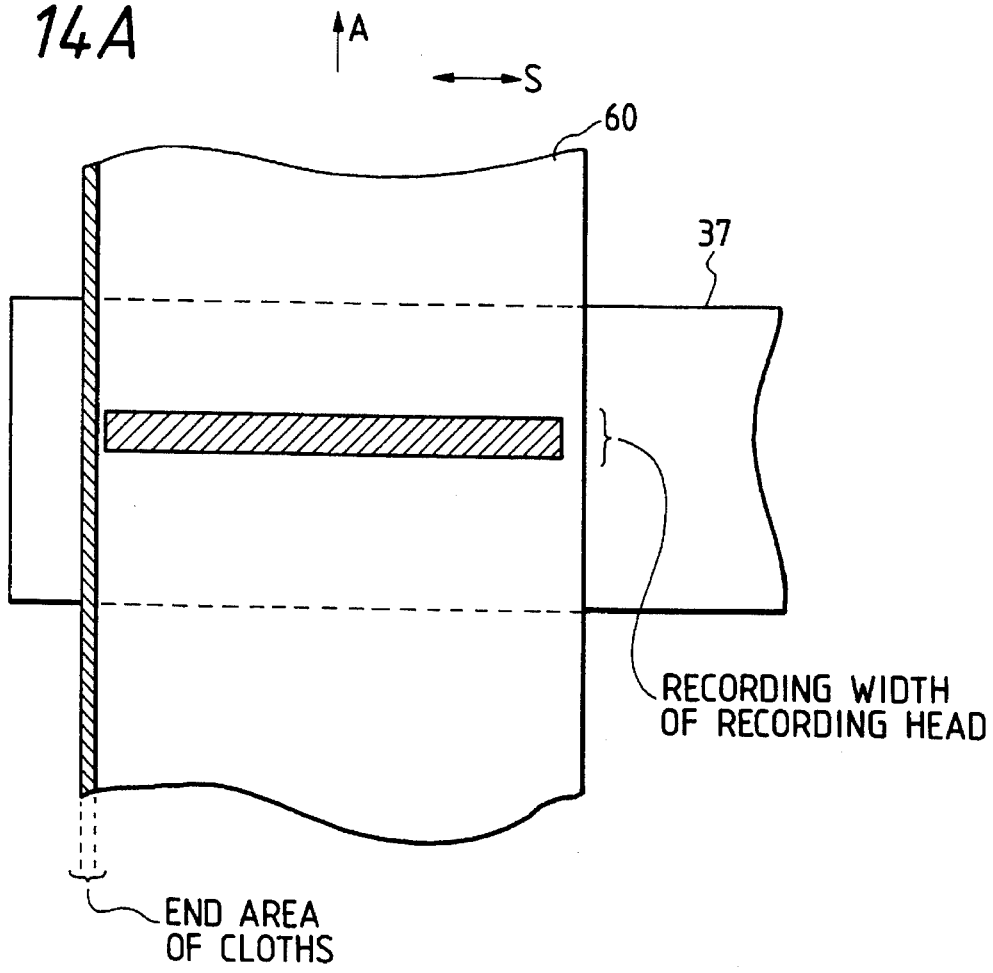
FIGS. 14A and 14B are schematic front and plan views respectively showing an example of the recording head moving control by the cloth thickness.
Figure 14B:
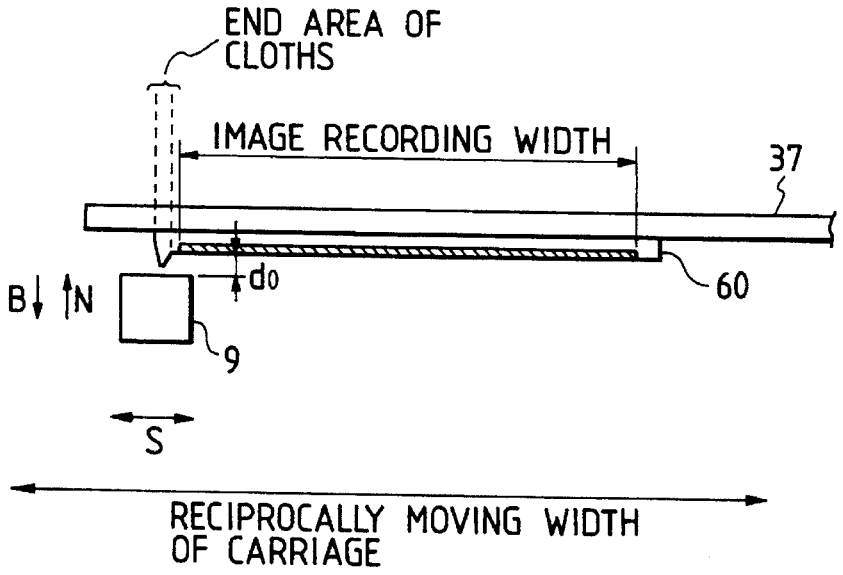

FIGS. 14A and 14B are schematic views of another embodiment for controlling the setting of the distance between the surface of the cloth 60 and the recording head 10 in accordance with the difference of the thickness of the cloth 60. In this embodiment, the distance between the surface of the cloth 60 and the recording head can be variably set in accordance with the difference in the thickness of the cloth depending on its position when an image is recorded thereon by the recording head 10 after the cloth 60 has been conveyed on the conveying belt 37.

Namely, as shown in FIGS. 14A and 14B, in some kinds of the cloth 60, textile threads of the cloth are projecting toward the end region thereof. If an image is recorded on such cloth 60 with a distance from the recording head 10 as an optimum distance $d_0$, the textile of the cloth 60 and the discharge port of the recording head 10 would come into contact at the projected cloth end so as to disturb the recording operation of the recording head 10. As a result, in such a case, the distance between the surface of the cloth 60 and the recording head 10 must be set to be larger than the optimum distance $d_0$ for image recording, such that white streaks due to the recording deviation of the dots would be easily generated on the recording image, thereby lowering the recorded image quality.

To over come such a disadvantage, in this embodiment the thread-projecting cloth end region is previously detected by the aforementioned cloth thickness detecting means 58 and the optical detecting means 65. In the cloth end region, the carriage 9 is retracted in the arrow B direction to locate the recording head 10 at a position separated from the surface of the cloth 60. After the carriage 9 moves in the arrow S direction and the recording head 10 passes through the cloth end region, the carriage 9 is forwarded in the arrow N direction until the distance between the recording head 10 and the surface of the cloth 60 becomes the optimum distance, and then the image recording operation on the cloth 60 by the recording head 10 is carried out.

Thus, by variably setting the distance between the surface of the cloth 60 and the recording head 10 in accordance with the difference in the thickness of the cloth due to its position, it is possible to record images of high quality without generating any white streaks due to the recording deviation of the dots even on a cloth with thickness varying in the reciprocally moving recording width. The thus dyed cloth 60 is of good quality with a desirable appearance.

In the operation sequence described with reference to FIG. 4, upon detection of any floating of the recording medium (cloth) from the conveying belt (platen), the recording operation is stopped.

Another embodiment will now be described. In this embodiment, whether the recording operation (carriage movement) is to be continued or not is determined in accordance with a distance between the recording medium and the head (floating amount) or a floating amount of the recording medium from the platen, by using a detecting means for detecting a floating amount of the recording medium along the main-scanning direction of the carriage.

As shown in FIG. 20, an ultrasonic sensor 101 (or an optical sensor) is disposed to direct toward the direction of the recording medium 102 as a detecting means for measuring any variation of the floating amount of the cloth as the recording medium along the main-scanning direction of the carriage. The variation of the floating amount of the recording medium along the main-scanning direction of the carriage in accordance with the carriage movement is measured.

The actual movement at this time will now be described with reference to FIG. 21. The measurement is carried out while performing the recording of the floating amount of the recording medium from the platen 104 in front of the recording direction of the ink jet recording unit 103 by the ultrasonic sensor 101 in accordance with the movement of the carriage in the main-scanning direction (S20). Here, it is also possible to scan once, in advance of the recording operation, the carriage for measuring only the floating amount of the recording medium and to store the data in the control unit.

Next, the floating amount data of contiguous measuring points among several floating amount measuring points in the main-scanning direction are compared to each other for calculating the floating angle of the recording medium 102 from the platen (S21).

Figure 22A:
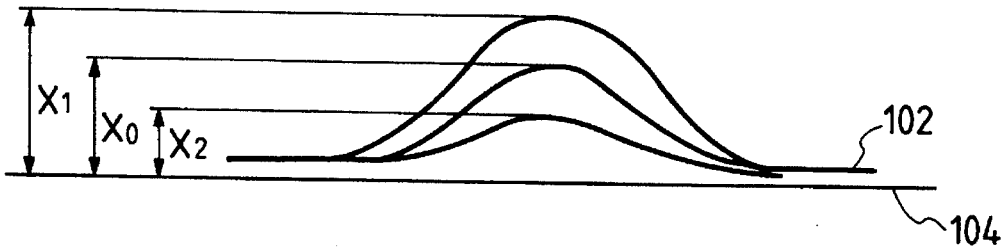
FIGS. 22A and 22B are diagrams for the explanation of the floating amount and angle of the recording medium.
Figure 22B:
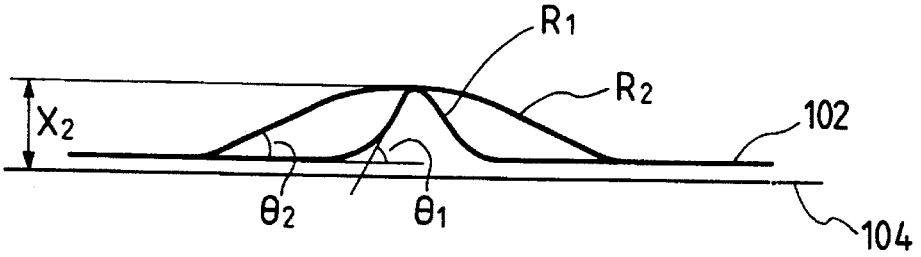

Subsequently, it is discriminated if the floating amount of the recording medium exceeds as predetermined amount X0 in S22 (FIG. 22A). If the measured floating amount X1 exceeds the predetermined value X0, it is warned to the outside, the carriage is moved to the HP, and the head is capped in S23. On the contrary, if the measured floating amount X2 is equal to or less than the predetermined value X0, it is discriminated whether the measured floating angle exceeds a predetermined floating angle or not in S24.

In S24 if the measured floating angle $\theta_1$, exceeds a predetermined floating angle $\theta_0$, the process shifts to S25 in which a warning is given to the outside, the carriage is returned to HP and the head is capped. On the other hand, when the measured floating angle $\theta_2$ is equal to or less than the predetermined value $\theta_0$, the process shifts to S26 for recording on the recording medium.

The predetermined floating amount X0 is a value determined mainly by a correlation of the main-scanning speed of the carriage and the moving speed of the head in the direction of separating from the recording medium. Namely, it should be such a floating amount as enabling the head to retract for preventing from contracting with the recording medium.

The predetermined floating angle $\theta_0$ is properly determined by the distance between the head and the recording medium (normally about 1 mm), magnitude of the head, and contiguous head space (space between the discharging openings). For example, as shown in FIG. 22B, even for the same floating amount X2, while the curve R1 is improper because of degradation of the recording quality (the recording image would be deviated in the main-scanning direction), the curve R2 is proper to continue recording without interrupting the recording operation since the gradient is gentle so as not degrade the recording quality. The optimum floating angle $\theta_0$ should be determined in view of the above-mentioned conditions.

According to such a sequence, when the recording is applied on a continuous sheet or a long cloth and in particular when it is an unmanned operation, an excellent results can be obtained, without causing any damage to the head due to the collision of the head with the recording medium while securely maintaining desirable recording quality.

Further, it would be more preferable to add the following processes for the dyeing operation on the cloth 60.

Namely, the following properties are required for the cloth 60 to be dyed by the ink jet recording method:

(1) The color of the ink can be developed thereon with a sufficient density;

(2) The dye fixing rate of the ink thereon is high;

(3) The ink can be dried quickly thereon;

(4) Irregular bleeding of the ink thereon would hardly occur; and (5) It would be easy to convey in the apparatus.

To meet these requirement, the cloths according to the present invention can be pre-processed. For example, in Japanese Patent Appln. Laid-open No. 62-53492, a kind of cloth containing an ink receiving layer is disclosed. Further in Japanese Patent Publication No. 3-46589, cloth containing an anti-reduction agent or alkaline substance is proposed. As an example of such a pre-processing, there is a process of making the cloths contain a substance selected from a group composed of alkaline substance, water-soluble macro molecules, synthetic macro molecules, water-soluble metallic salt, urea and thiourea.

As the alkaline substance, there are alkali metal hydroxides such as sodium hydroxide or potassium hydroxide, amine class including monotriethanolamine and diethanolamine, sodium carbonate, carbonic acid such as sodium bicarbonate or alkali metallic salt. Further, organic acid metallic salts such as calcium acetate and barium acetate, ammonia or ammonia compounds can be included therein. Furthermore, sodium trichloroacetic acid and the like which becomes an alkali substance under steaming or dry sterilizing condition are also available. Particularly preferable alkaline substances are sodium carbonate and sodium bicarbonate used for dyeing process using reactive dye.

As the water-soluble macro molecules, there are starch substances such as corn and wheat, cellulose-type substances such as carboxymethyl cellulose, methyl cellulose, hydroxyethyl cellulose, sodium alginate, gum arabic, locasweetbeam gum, tragacanth gum, gua gum, polysaccharide such as tamarind seed, protein substances such as gelatin and casein, and natural water-soluble macro molecules such as tannine-type substances and lignin-type substances.

Further, the synthetic macro molecules include, for example, polyvinylalcohol-type compounds, polyethylene oxide-type compounds, acrylic acid-type water-soluble macro molecules, and maleic anhydride-type water-soluble macro molecules. Among them polysaccharide-type macro molecules and cellulose-type macro molecules are particularly preferable.

The water-soluble metallic salt includes, for example, compounds of Ph 4–10 forming typical ionic crystals such as halogenides of alkali metal and alkaline earth metal. Typical examples of such compounds are as alkali metal NaCl, $Na_2SO_4$, KCl and $CH_3$ COONa, and as alkaline earth metal $CaCl_2$ and $MgCl_2$. In particular, among them, the salts of Na, K and Ca classes are preferable.

There is no limitation for the method for making the cloths contain the above-mentioned substances, but normally soaking method, bud method, coating method or spraying method are used.

Since the dyeing ink when applied to the ink jet dyeing cloths is merely in an adhered state thereon, it is preferable to perform subsequently a process for reactively fixing the dye to the texture of the cloths. As conventionally known examples of this reactive fixing process, there are steaming method, HT steaming method and thermo-fixing method to be used. If no pre-alkali processed cloths are used, alkali pad steam method, alkali blotch steam method, alkali shocking method and alkali cold fixing method are used.

Further, not reacted dyes and the substances used in the pre-processing can be eliminated by washing in accordance with the conventionally known method after the reactive fixing process. It is preferable to apply the conventional fixing process along with this washing process.

In the above-described embodiments, cloths have been used as a recording medium, but alternatively wall paper also can be used. In this case, the wall paper includes that formed of paper, cloth, or plastic sheet made of plastic chloride resin, for example, as the material.

Next, an ink jet recording method using thermal energy will be described.

The present invention preferably uses an ink jet recording method, and is particularly effective for an ink jet type recording head and recording apparatus which use thermal energy to form ejected liquid drops for recording.

For this type of recording method, it is preferable to use the basic principles disclosed in, for example, U.S. Pat. No. 4,723,129 and 4,740,796. This method can be applied to both on-demand type and continuous type. Particularly in case of on-demand type, at least one driving signal for quickly increasing the temperature beyond the nucleate boiling corresponding to the recording information is applied to an electrothermal converter disposed correspondingly in a sheet or a liquid path in which the liquid (ink) is kept. Then the electrothermal converter generates heat energy to cause membrane boiling on the thermal operating surface of the recording head, resulting in bubbles formed in the liquid corresponding one by one to the individual driving signal. The ink is discharged through the discharging opening by the growing and contracting of the bubbles to for at least on drop. By forming the driving signal in pulse-shape, the growing and contracting of the bubbles can be performed quickly and properly so as to achieve discharging of the ink with an excellent responsive property.

As this pulse-type driving signal, those disclosed in U.S. Pat. Nos. 4,463,359 and 4,345,262 are suitable. A more desirable recording operation can be carried out by using conditions disclosed in U.S. Pat. No. 4,313,124 relating to a temperature raising rate at the thermal operating surface.

As the structure of the recording head according to the present invention, not only the combination of the discharge port, liquid path and electrothermal converter as disclosed in above-noted U.S. patents (linear liquid flowing path or rectilinear liquid flowing path), but also those disclosed in U.S. Pat. Nos. 4,558,333 and 4,459,600 relating to a thermal operating surface disposed in a folded region are included.

In addition, the present invention would be also effective when based on a composition disclosed in Japanese Patent Laid-Open No. 59-123670 relating to use of a common slit as a discharge port for a plurality of electrothermal converters, and in Japanese Patent Laid-Open No. 59-138461 relating to an opening for absorbing a pressure wave of the thermal energy corresponding to a discharge port.

Further, as a full-line type recording head having a length corresponding to the width of the maximum recording medium capable of being recorded by the recording apparatus, any of the compositions disclosed in the above-noted U.S. patents in which a combination of a plurality of recording heads meets the required length and an integrally composed single recording head can be used, but the composition of the present invention can provide the above-mentioned effect much more efficiently.

The present invention is also effective for a removable chip-type recording head, which upon mounting on the apparatus body, can be electrically coupled to the body and can receive ink supply from the body, or a cartridge-type recording head, which itself has an ink tank equipped therewith integrally.

It is also preferable to add a recovery means and supplementary and preliminary means for the recording head for providing more stable effects of the present invention. These means includes, specifically, a capping means for the recording head, cleaning means, pressing or attracting means, electrothermal converter or separate heating element or a preliminary heating means formed by a combination thereof. Further, it is also effective for achieving a stable recording operation to carry out a preliminary discharging mode separately from the discharging operation for recording.

Also, with respect to recording mode of the apparatus, the present invention is quite preferable for a multiple color apparatus or a full color apparatus utilizing mixed colors, which is composed of a single recording head or a combination of a plurality thereof, and is not limited to a monochromatic recording mode such as black.

Although the ink has been used as the liquid in the aforementioned embodiments of the present invention, any other types of liquid can be used, for example those that soften or liquefy at a room temperature, and those that solidify at a room temperature or less. Further, since, in the ink jet recording method, it is usual to control the viscosity of the ink to be within a stable discharging range by adjusting the temperature of the ink itself in a range 30° C.–70° C., any type of ink which can liquefy when the recording signal is supplied can be used.

Moreover, the present invention can be also applied to an apparatus using ink which does not liquefy until receiving thermal energy, including one which liquefies upon receiving thermal energy in accordance with a recording signal to be discharged as a liquid ink, and one which starts solidifying upon reaching the recording medium, by positively preventing the temperature rising of the apparatus due to the thermal energy by using the energy for varying the ink from solid state to liquid state, or by using an ink which solidifies when left unused for preventing the evaporation. In such a case, the ink can be kept as a liquid or solid in concave portion or through hole of the porous sheet to be opposed to the electrothermal converter, as disclosed in Japanese Patent Laid-Open No. 54-56847 or No. 60-71260. In the present invention, the most effective method for such types of ink is the aforementioned membrane boiling method.

Furthermore, the recording apparatus according to the present invention can be composed in such a form as an image output terminal of an information processing apparatus such as a word processor and a computer provided integrally therewith or separately therefrom, a copy machine in combination with a reader, etc., and further as a facsimile apparatus having transmission/reception functions.

In the ink jet recording apparatus according to the present invention, it is possible to prevent the collision of the recording head with the recording medium by providing a detecting means for detecting any abnormality in conveying the recording medium and a means for varying the distance between the recording head and the recording medium in accordance with the detected result of the detecting means so as to increase the distance between the recording head and the recording medium when such abnormality takes place. As a result, the recording medium can be prevented from being stained and the recording head supporting mechanism would not suffer from undesirable effect caused by the collision.

Further, by establishing two distances, one as a recording state and one as a retracting state, the apparatus and the controlling operation thereof can be simplified.

Furthermore, if the distance between the recording head and the recording medium increases upon detection of the floating of the recording medium, the timing for increasing the distance would become the optimum.

By providing a detecting means for detecting the recording medium thickness instead of the detecting means for detecting the conveying abnormality of the recording medium, it becomes possible to locate the recording head at a position suitable for the thickness of the recording medium so as to record a high-quality image without any undesirable white line.

With respect to the recording operation on the cloths or wall sheets, the ink jet recording method does not required any screen form to be used as in screen textile printing so as to significantly reduce the processes and time for completing the printing on the cloths or wall sheets. In addition, the apparatus can be composed compactly and the printing/recording operation on the cloths or wall sheets can be carried out in accordance with the requirements for high-quality image.

In the method for manufacturing products by the ink jet recording method in the aforementioned embodiments, high-quality printing products can be obtained even when any abnormalities occur on the recording medium, by detecting the abnormality and adjusting the distance between the recording head and the recording medium in accordance therewith. In particular, any undesirable contact of the recording head and the recording medium can be prevented by detecting the conveying abnormality, for example, due to its floating, so as to provide clean and stainless printing products.

It is possible to provide recording products with high-quality image irrespective of the thickness of the recording medium, by varying the distance between the recording head and the recording medium in accordance with the detected thickness of the recording medium.

The recording product having been manufactured by the ink jet recording method according to the present invention has a desirable high image quality and an excellent appearance.

What is claimed is:

1. A recording apparatus for recording an image, by a recording device, on a recording medium having been conveyed to a position opposite to the recording device, said apparatus comprising:

a platen;

conveying means for conveying the recording medium to a recording region where a platen is disposed;

detecting means for detecting a floating angle of the recording medium with respect to the platen; and selecting means for selecting either a first mode to continue a recording operation by varying a distance between the recording device and the recording medium in accordance with a detected result of said detecting means or a second mode to stop the recording operation.

2. A recording apparatus according to claim 1, wherein said recording medium is comprised of cloth.

3. A recording apparatus according to claim 1, wherein said recording medium is comprised of a wall sheet made of paper, cloths or plastic resin material.

4. A recording apparatus according to claim 1, wherein said recording device comprises an ink jet recording head for recording on the recording medium by ejecting ink.

5. A recording apparatus according to claim 4, wherein said ink jet recording head comprises an electrothermal converter for generating thermal energy to eject the ink from the ink discharge port.

6. A method for producing an ink jet recorded product by recording an image, with an ink jet recording device including a platen, on a recording medium having been conveyed to a position opposite to the recording device, said method comprising the steps of:

conveying the recording medium to a recording region where the platen is disposed;

detecting a floating angle of the recording medium with respect to the platen; and selecting either a first mode to continue a recording operation by varying a distance between the recording device and the recording medium in accordance with a detected result of said detecting step or a second mode to stop the recording operation.

7. A method according to claim 6, wherein said recording medium is comprised of cloth.

8. A method according to claim 6, wherein said recording medium comprises a wall sheet made of paper, cloth or plastic resin material.

9. A method according to claim 6, further comprising a step of:

adding a pre-processing agent to the recording medium before the image is recorded on the recording medium.

10. A method according to claim 6, further comprising a step of:

fixing the ink on the recording medium after the image is recorded on the recording medium.

11. A method according to claim 10, further comprising a step of:

cleaning the recording medium which has been image-recorded after said fixing step.

12. A method according to claim 6, wherein said ink jet recording device is provided with an electrothermal converter for generating thermal energy to eject the ink from an ink discharge port.

13. A method for producing an ink jet recorded product by recording an image, with an ink jet recording device including a platen, on a recording medium having been conveyed to a position opposite to the recording device, said method comprising the steps of:

conveying the recording medium to a recording region where the platen is disposed;

detecting a floating amount of the recording medium with respect to the platen;

calculating a floating angle of the recording medium with respect to the platen based on the detected floating amount; and selecting a first mode at which recording is continued when said calculated floating angle is less than a predetermined angle and a second mode at which recording is interrupted when said calculated floating angle exceeds the predetermined angle.

14. A method according to claim 13, wherein said recording medium is comprised of cloth.

15. A method according to claim 13, wherein said recording medium comprises a wall sheet made of paper, cloth or plastic resin material.

16. A method according to claim 13, further comprising a step of:

adding a pre-processing agent to the recording medium before the image is recorded on the recording medium.

17. A method according to claim 13, further comprising the step of:

fixing the ink on the recording medium after the image is recorded on the recording medium.

18. A method according to claim 17, further comprising the step of:

cleaning the recording medium which has been image-recorded after said fixing step.

19. A method according to claim 13, wherein said ink jet recording device is provided with an electrothermal converter for generating thermal energy to eject the ink from an ink discharge port.

20. A method according to claim 13, wherein the ink jet recording device comprises an ink jet recording head for recording on the recording medium by ejecting ink.

21. A method according to claim 13, wherein said detecting step is effected with a light emitting unit and a light receiving unit.

22. A method according to claim 13, wherein said detecting step is effected with means for comparing floating distances of the recording medium from the platen to provide a floating angle and means for identifying a floating condition if a floating angle exceeds a predetermined angle.

23. A method according to claim 22, wherein the predetermined angle is a floating angle at which recording can continue without substantially affecting recording quality.

24. A recording apparatus according to claim 1, wherein said detecting means comprises a light emitting unit and a light receiving unit.

25. A recording apparatus according to claim 1, wherein the detecting means comprises means for comparing floating distances of the recording medium from the platen to provide a floating angle and means for identifying a floating condition if a floating angle exceeds a predetermined angle.

26. A recording apparatus according to claim 25, wherein the predetermined angle is a floating angle at which recording can continue without substantially affecting recording quality.

27. A method according to claim 6, wherein the ink jet recording device comprises an ink jet recording head for recording on the recording medium by ejecting ink.

28. A method according to claim 6, wherein said detecting step is effected with a light emitting unit and a light receiving unit.

29. A method according to claim 6, wherein said detecting step is effected with means for comparing floating distances of the recording medium from the platen to provide a floating angle and means for identifying a floating condition if a floating angle exceeds a predetermined angle.

30. A method according to claim 29, wherein the predetermined angle is a floating angle at which recording can continue without substantially affecting recording quality.

31. A recording apparatus for recording an image, with a recording device, on a recording medium having been conveyed to a position opposite to the recording device, said apparatus comprising:

a platen;

detecting means for detecting a floating angle of the recording medium with respect to the platen; and control means for interrupting recording by the recording device when the floating angle detected by said detecting means exceeds a predetermined angle.

32. A recording apparatus according to claim 31, wherein the recording medium is comprised of cloth.

33. A recording apparatus according to claim 31, wherein the recording medium is comprised of a wall sheet made of paper, cloth or plastic resin material.

34. A recording apparatus according to claim 31, wherein the recording device comprises an ink jet recording head for recording on the recording medium by ejecting ink.

35. A recording apparatus according to claim 34, wherein said ink jet recording head comprises an electrothermal converter for generating thermal energy to eject the ink from an ink discharge port.

36. A recording apparatus for recording an image, with a recording device, on a recording medium having been conveyed to a position opposite to the recording device, said apparatus comprising:

a platen;

detecting means for detecting a distance between the recording medium and the recording device;

calculating means for calculating a floating angle of the recording medium with respect to said platen based on the distance detected by said detecting means; and control means for enabling recording by the recording device when the distance between the recording medium and the recording device is equal to or less than a predetermined value and the floating angle calculated by said calculating means is equal to or less than a predetermined angle.

37. A recording apparatus according to claim 36, wherein the recording medium is comprised of cloth.

38. A recording apparatus according to claim 36, wherein the recording medium is comprised of a wall sheet made of paper, cloth or plastic resin material.

39. A recording apparatus according to claim 36, wherein the recording device comprises an ink jet recording head for recording on the recording medium by ejecting ink.

40. A recording apparatus according to claim 39, wherein said ink jet recording head comprises an electrothermal converter for generating thermal energy to eject the ink from an ink discharge port.

* * * * *

UNITED STATES PATENT AND TRADEMARK OFFICE

CERTIFICATE OF CORRECTION

PATENT NO. : 5,541,626 Page 1 of 3

DATED : July 30, 1996

INVENTOR(S) : Akira HIRAMATSU, et al.

It is certified that error appears in the above-indentified patent and that said Letters Patent is hereby corrected as shown below:

Title page,

AT [56] References Cited - FOREIGN PATENT DOCUMENTS:

"1122474 5/1989 Japan .
2086457 3/1990 Japan .
2217278 8/1990 Japan .
3046589 7/1991 Japan ."

should read

--1-122474 5/1989 Japan .
2-086457 3/1990 Japan .
2-217278 8/1990 Japan .
3-046589 7/1991 Japan .--.

COLUMN 2:

Line 39, "are" should read --is--.

COLUMN 6:

Line 9, "the" (first occurrence) should be deleted.

UNITED STATES PATENT AND TRADEMARK OFFICE

CERTIFICATE OF CORRECTION

PATENT NO. : 5,541,626

DATED : July 30, 1996

INVENTOR(S) : Akira HIRAMATSU, et al.

It is certified that error appears in the above-indentified patent and that said Letters Patent is hereby corrected as shown below:

COLUMN 7:

Line 28, "directing" should read --directed--.

COLUMN 8:

Line 12, "in" should read --in the--.

COLUMN 13:

Line 55, "over come" should read --overcome--.

COLUMN 15:

Line 18, "an" (second occurrence) should be deleted;

Line 34, "requirement," should read --requirements,--;

Line 62, "gua gum," should read --guar gum--.

COLUMN 16:

Line 47, "in" should read --in the--;

Line 58, "for" should read --form--;

Line 59, "on" should read --one--.

UNITED STATES PATENT AND TRADEMARK OFFICE

CERTIFICATE OF CORRECTION

PATENT NO. : 5,541,626 Page 3 of 3

DATED : July 30, 1996

INVENTOR(S) : Akira HIRAMATSU, et al.

It is certified that error appears in the above-indentified patent and that said Letters Patent is hereby corrected as shown below:

COLUMN 17:

Line 33, "includes," should read --include,--.

COLUMN 18:

Line 41, "required" should read --require--.

COLUMN 19:

Line 24, "cloths" should read --cloth--.

Signed and Sealed this

Third Day of June, 1997

*Attest:*

*Attesting Officer*

Bruce Lehman

BRUCE LEHMAN

*Commissioner of Patents and Trademarks*